US009170507B2

(12) United States Patent
Sugiyama et al.

(10) Patent No.: US 9,170,507 B2
(45) Date of Patent: Oct. 27, 2015

(54) METHOD OF PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kazumichi Sugiyama, Numazu (JP); Daisuke Tanaka, Yokohama (JP); Tsutomu Nishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 19 days.

(21) Appl. No.: 14/148,069

(22) Filed: Jan. 6, 2014

(65) Prior Publication Data

US 2014/0205946 A1 Jul. 24, 2014

(30) Foreign Application Priority Data

Jan. 18, 2013 (JP) ..... 2013-007477

(51) Int. Cl.

| | |
|---|---|
| ***G03G 5/00*** | (2006.01) |
| ***G03G 5/05*** | (2006.01) |
| ***G03G 5/147*** | (2006.01) |

(52) U.S. Cl.

CPC ..... *G03G 5/0503* (2013.01); *G03G 5/056* (2013.01); *G03G 5/0525* (2013.01); *G03G 5/0546* (2013.01); *G03G 5/0564* (2013.01); *G03G 5/0578* (2013.01); *G03G 5/14734* (2013.01); *G03G 5/14752* (2013.01); *G03G 5/14756* (2013.01); *G03G 5/14773* (2013.01)

(58) Field of Classification Search

CPC ..... G03G 5/14752; G03G 5/14756; G03G 5/14773

USPC ..... 430/132, 66

See application file for complete search history.

(56) References Cited

U.S. PATENT DOCUMENTS

| | | | |
|---|---|---|---|
| 4,716,091 | A | 12/1987 | Yoshihara et al. |
| 6,562,530 | B2 | 5/2003 | Morikawa et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,913,862 | B2 | 7/2005 | Nakata et al. |

(Continued)

FOREIGN PATENT DOCUMENTS

| | | |
|---|---|---|
| EP | 2 733 536 A1 | 5/2014 |
| JP | 58-167606 A | 10/1983 |

(Continued)

OTHER PUBLICATIONS

Tanaka, et al., U.S. Appl. No. 14/146,457, filed Jan. 2, 2014.

(Continued)

*Primary Examiner* — Mark A Chapman

(74) *Attorney, Agent, or Firm* — Fitzpatrick, Cella, Harper and Scinto

(57) ABSTRACT

Provided is a method of producing an electrophotographic photosensitive member including a support and a surface layer formed on the support, the method including the steps of forming a coat of a surface-layer coating solution, and drying the coat to form the surface layer, in which the surface-layer coating solution includes resin α, resin β, solvent γ, and compound δ.

13 Claims, 1 Drawing Sheet

(56) References Cited

U.S. PATENT DOCUMENTS

| | | | | |
|---|---|---|---|---|
| 6,998,210 | B2 | 2/2006 | Yoshimura et al. | |
| 7,022,446 | B2 | 4/2006 | Yoshimura et al. | |
| 7,078,140 | B2 | 7/2006 | Yoshimura et al. | |
| 8,632,935 | B2 | 1/2014 | Sugiyama et al. | |
| 2005/0233235 | A1* | 10/2005 | Qi et al. | 430/66 |
| 2011/0158683 | A1 | 6/2011 | Okuda et al. | |
| 2013/0029256 | A1 | 1/2013 | Tanaka et al. | |
| 2013/0221560 | A1 | 8/2013 | Kawai et al. | |
| 2014/0093281 | A1 | 4/2014 | Takahashi et al. | |

FOREIGN PATENT DOCUMENTS

| | | | |
|---|---|---|---|
| JP | 62-75462 | A | 4/1987 |
| JP | 6-123987 | A | 5/1994 |
| JP | 2001-343767 | A | 12/2001 |
| JP | 2007-47655 | A | 2/2007 |
| JP | 2007-72277 | A | 3/2007 |
| JP | 2007-79555 | A | 3/2007 |
| JP | 2007-199688 | A | 8/2007 |
| JP | 2009-37229 | A | 2/2009 |
| WO | 2012/057349 | A1 | 5/2012 |

OTHER PUBLICATIONS

Nishi, et al., U.S. Appl. No. 14/152,438, filed Jan. 10, 2014.
Matsuda, et al., U.S. Appl. No. 14/284,945, filed May 22, 2014.
Miura, et al., U.S. Appl. No. 14/160,445, filed Jan. 21, 2014.
Miura, et al., U.S. Appl. No. 14/160,437, filed Jan. 21, 2014.
European Search Report dated Jun. 4, 2014 in European Application No. 14000183.5.

* cited by examiner

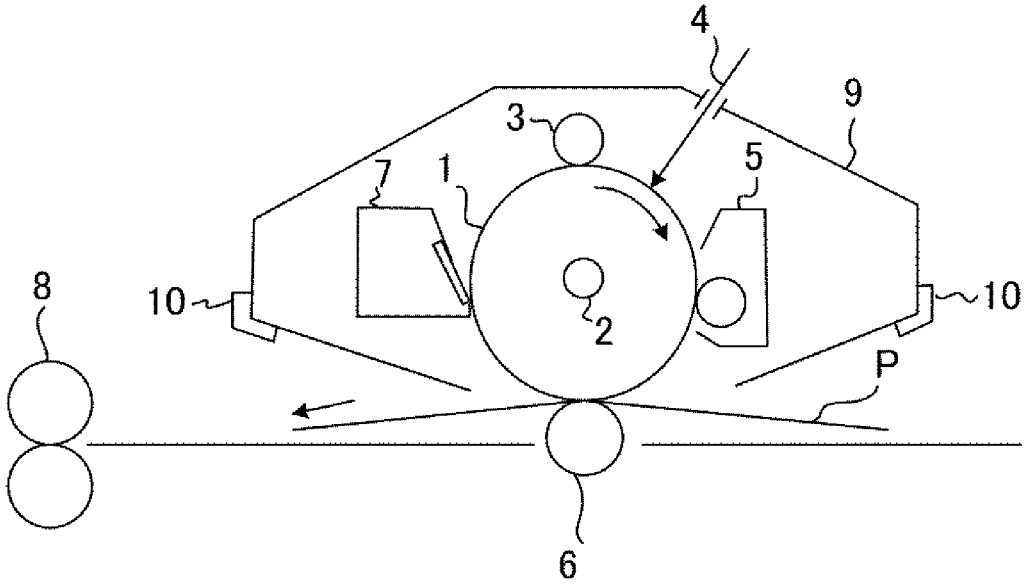
4
9
3
7
1
5
8
10
2
10
P
6

METHOD OF PRODUCING ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to a method of producing an electrophotographic photosensitive member, a process cartridge, and an electrophotographic apparatus.

2. Description of the Related Art

An electrophotographic photosensitive member containing an organic photoconductive substance (charge-generating substance) has been frequently used as an electrophotographic photosensitive member to be mounted on an electrophotographic apparatus. In an electrophotographic process, a cleaning step of removing transfer residual toner with a cleaning blade has been required to reduce a contact stress (coefficient of friction) between the cleaning blade and the electrophotographic photosensitive member in order that the occurrence of a phenomenon such as the squeaking of the cleaning blade or the turn-up of the cleaning blade may be suppressed.

The incorporation of a siloxane-modified resin having a siloxane structure in its molecular chain into the surface layer of the electrophotographic photosensitive member, which is brought into contact with a contact member (such as the cleaning blade), has been proposed for reducing the contact stress of the electrophotographic photosensitive member. Japanese Patent Application Laid-Open No. 2009-037229 discloses a technology involving incorporating a resin obtained by building a siloxane structure in a polycarbonate resin into the surface layer to reduce the contact stress (coefficient of friction) between the electrophotographic photosensitive member and the cleaning blade.

The surface layer of the electrophotographic photosensitive member is formed by: applying, onto a support or the like, a surface-layer coating solution obtained by dissolving or dispersing a binder resin or the like in a solvent to form a coat; and drying the coat. In addition, the solvent is selected in consideration of the solubility of the binder resin or the like, the absence of influences on electrophotographic characteristics, and the absence of the whitening, sagging, or the like of the coat at the time of its coating. As described above, from the viewpoint of compatibility between the electrophotographic characteristics and coatability, various investigations have been conducted on the solvent to be used as the solvent of the coating solution. Japanese Patent Application Laid-Open No. 2001-343767 proposes a method of producing an electrophotographic photosensitive member free of whitening at the time of coating and having electrophotographic characteristics comparable to or better than those in the case where a halogen-based solvent is used, the method involving using an aromatic hydrocarbon and ethylene glycol dimethyl ether as solvents of a charge-transporting-layer coating solution. Japanese Patent Application Laid-Open No. H06-123987 proposes that a drying temperature at the time of the production of an electrophotographic photosensitive member and the boiling point of a solvent to be used in a photosensitive-layer coating solution be regulated for suppressing the defects of a coat.

In Japanese Patent Application Laid-Open No. 2009-037229 or the like, in the production of an electrophotographic photosensitive member containing, in its surface layer, a resin having a siloxane structure, a solvent to be used in a surface-layer coating solution contains a halogen-based solvent such as monochlorobenzene from the viewpoints of the solubilities of the resin having a siloxane structure and any other material. In recent years, however, the relevance of a chemical substance to an environment has been attracting attention, and the management of the chemical substance and the regulation of its amount of emission have been enhanced. As part of the enhancement, the replacement of the halogen-based solvent with a non-halogen-based solvent has been progressing. In addition, the halogen-based solvent must be recovered separately from the non-halogen-based solvent upon waste liquid recovery and hence productivity is liable to reduce. In view of the foregoing, its replacement with the non-halogen-based solvent has been demanded. Examples of the non-halogen-based solvent suitable for use in the surface-layer coating solution for the electrophotographic photosensitive member include xylene and toluene.

However, in the case where toluene or xylene is used as the solvent of the surface-layer coating solution containing the resin having a siloxane structure for reducing the contact stress of the surface layer, a reducing effect on an initial coefficient of friction is not sufficiently obtained as compared with that in the case where monochlorobenzene is used, and hence the initial coefficient of friction needs to be reduced.

SUMMARY OF THE INVENTION

In view of the foregoing, the present invention is directed to providing a method of producing an electrophotographic photosensitive member, the method including the step of applying a surface-layer coating solution containing a resin having a siloxane moiety, and at least one of toluene and xylene to form a surface layer, in which an initial coefficient of friction in the surface of the electrophotographic photosensitive member is reduced. Further, the present invention is directed to providing an electrophotographic photosensitive member produced by the method of producing an electrophotographic photosensitive member, and a process cartridge and an electrophotographic apparatus each including the electrophotographic photosensitive member.

The above-mentioned objects are achieved by the present invention described below.

According to one aspect of the present invention, there is provided a method of producing an electrophotographic photosensitive member including a surface layer, in which the method includes the following steps of: forming a coat of a surface-layer coating solution; and drying the coat to form the surface layer, in which the surface-layer coating solution includes: ($\alpha$) at least one resin selected from the group consisting of a polycarbonate resin not having a siloxane moiety at an end thereof, and a polyester resin not having a siloxane moiety at an end thereof; ($\beta$) at least one resin selected from the group consisting of a polycarbonate resin having a siloxane moiety at an end thereof, a polyester resin having a siloxane moiety at an end thereof, and a polyacrylate resin having a siloxane moiety at an end thereof; ($\gamma$) at least one solvent selected from the group consisting of toluene and xylene; and ($\delta$) a compound having a boiling point in one atmosphere higher than that of the solvent of the ($\gamma$), the compound being represented by the following formula (1);

(1)

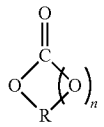

wherein, in the formula (1), R represents an alkylene group having 1 to 5 carbon atoms, and n represents 0 or 1.

According to another aspect of the present invention, there is provided a process cartridge detachably mountable to a main body of an electrophotographic apparatus, in which the process cartridge integrally supports: an electrophotographic photosensitive member produced by the above-described method of producing an electrophotographic photosensitive member; and at least one device selected from the group consisting of a charging device, a developing device, a transferring device, and a cleaning device.

According to further aspect of the present invention, there is provided an electrophotographic apparatus including: an electrophotographic photosensitive member produced by the above-described method of producing an electrophotographic photosensitive member; a charging device; an exposing device; a developing device; and a transferring device.

According to the present invention, there is provided the method of producing an electrophotographic photosensitive member, the method including the steps of applying a surface-layer coating solution containing a resin having a siloxane moiety, and at least one of toluene and xylene to form a coat, and then drying the coat to form a surface layer, in which an initial coefficient of friction in the surface of the electrophotographic photosensitive member is reduced.

Further features of the present invention will become apparent from the following description of exemplary embodiments with reference to the attached drawing.

BRIEF DESCRIPTION OF THE DRAWING

FIGURE is a view illustrating an example of the schematic construction of an electrophotographic apparatus including a process cartridge having an electrophotographic photosensitive member of the present invention.

DESCRIPTION OF THE EMBODIMENTS

A method of producing an electrophotographic photosensitive member of the present invention includes the following steps of: forming a coat of a surface-layer coating solution; and drying the coat to form the surface layer, in which the surface-layer coating solution includes as constituents thereof: (α) at least one resin selected from the group consisting of a polycarbonate resin not having a siloxane moiety at an end thereof, and a polyester resin not having a siloxane moiety at an end thereof (constituent (α)); (β) at least one resin selected from the group consisting of a polycarbonate resin having a siloxane moiety at an end thereof, a polyester resin having a siloxane moiety at an end thereof, and a polyacrylate resin having a siloxane moiety at an end thereof (constituent (β)); and (γ) at least one solvent selected from the group consisting of toluene and xylene (constituent (γ)); and further, (δ) a compound having a boiling point in one atmosphere higher than that of the (γ), the compound being represented by the following formula (1) (constituent (δ)).

(1)

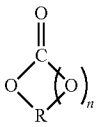

In the formula (1), R represents an alkylene group having 1 to 5 carbon atoms, and n represents 0 or 1.

Hereinafter, the (α) is sometimes referred to as "resin α", the (β) is sometimes referred to as "resin β", the (γ) is sometimes referred to as "solvent γ", and the (δ) is sometimes referred to as "compound δ".

The inventors of the present invention assume the reason why an initial coefficient of friction in the surface of the electrophotographic photosensitive member can be reduced by incorporating the compound δ into the surface-layer coating solution in the present invention to be as described below.

In the present invention, the surface of the electrophotographic photosensitive member having a low initial coefficient of friction is obtained through the following: the resin β having a siloxane moiety migrates to the surface of the electrophotographic photosensitive member (surface migration) and the siloxane moiety is distributed in the surface of the electrophotographic photosensitive member. The surface migration of the resin β is performed in the step of drying the coat formed by applying the surface-layer coating solution. The resin α and the resin β need to be in a state of easily separating from each other in the drying step in order that the resin β may migrate to the surface of the photosensitive member.

However, the resin α and the resin β need to be compatible with each other to some extent from the viewpoints of the stability of the coating solution (surface-layer coating solution) and the uniformity of the coat. Therefore, the repeating structural unit of the resin β having a siloxane moiety needs to be selected so as to be easily compatible with the resin α. When a dimethyl silicone oil is used instead of the resin β in the present invention, the dimethyl silicone oil is hardly compatible with the resin α and easily migrates to the surface of the electrophotographic photosensitive member. However, compatibility between the dimethyl silicone oil and the resin α is so low that the dimethyl silicone oil is scattered in the surface of the electrophotographic photosensitive member and an electrophotographic photosensitive member whose surface has a uniformly low coefficient of friction is not obtained. In addition, in the state of the coating solution as well, the dimethyl silicone oil separates and becomes opaque, and hence the stability of the solution is not sufficiently obtained.

On the other hand, when xylene or toluene is used as the solvent of the surface-layer coating solution, the resin α and the resin β are easily compatible with each other, and the resin α and the resin β hardly separate from each other in the drying step, and hence the resin β hardly migrates to the surface and a sufficient initial coefficient of friction is not obtained. In view of the foregoing, in the present invention, the compound δ is incorporated into the surface-layer coating solution for establishing a state where the resin α and the resin β easily separate from each other in the drying step while maintaining the stability of the coating solution and the uniformity of the coat. The inventors of the present invention assume the reason why the incorporation of the compound δ having a boiling point in one atmosphere higher than that of the solvent γ out of the compounds each having a structure represented by the formula (1) facilitates the separation of the resin α and the resin β to be as described below.

Compatibility between a polar group (COO bond) in each of the repeating structural units of the resin α and the resin β and a polar group (C═O bond) of the compound δ is high. It is assumed that the presence of the compound δ raises the difficulty with which the repeating structural units of the resin α and the resin β are entangled with each other, and hence the state where the resin α and the resin β easily separate from each other is obtained. In addition, the state where the resin α and the resin β easily separate from each other can be maintained till the end of the drying step by making the boiling point of the compound δ higher than the boiling point of the solvent γ. When the boiling point of the compound δ is higher than the boiling point of the solvent γ, the solvent γ volatilizes faster than the compound δ in the drying step and hence the ratio of the compound δ in the coat increases. It is therefore assumed that while the surface-layer coating solution is stable because the content of the compound δ is low as compared with the solvent γ in the coating solution, the content of the compound δ in the coat increases in the drying step, and hence the resin α and the resin β are brought into a state of easily separating from each other.

In actuality, when the case where only the solvent γ is added as a solvent to the resin α and resin β of the surface-layer coating solution, and the case where not only the solvent γ but also the compound δ is added thereto are compared, opacity considered to be derived from the fact that the resin α and the resin β are in a separated state is more clearly observed in the surface-layer coating solution in the case where the compound δ is added.

<Compound δ>

The compound δ in the present invention is a compound having a boiling point in one atmosphere higher than that of the (γ) out of the compounds each represented by the following formula (1). The boiling point of xylene is 138 to 144° C. The boiling point of toluene is 111° C.

(1)

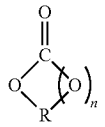

In the formula (1), R represents an alkylene group having 1 to 5 carbon atoms, and n represents 0 or 1.

The compound having a boiling point in one atmosphere higher than that of the (γ) is a compound having a boiling point in one atmosphere higher than that of toluene when the solvent γ is toluene alone. When xylene and toluene are used as the solvent γ, the compound is a compound having a boiling point in one atmosphere higher than that of xylene. When the solvent γ is xylene alone, the compound is a compound having a boiling point in one atmosphere higher than that of xylene.

For example, propylene carbonate (240° C.), γ-butyrolactone (204° C.), δ-valerolactone (230° C.), and ε-caprolactone (253° C.) are given as specific compounds of the compound δ. It should be noted that each of the numerical values in the parentheses indicates the boiling point in one atmosphere.

Of those, propylene carbonate, γ-butyrolactone, and δ-valerolactone are preferred.

Structural formulae of the specific compounds of the compound δ are shown below.

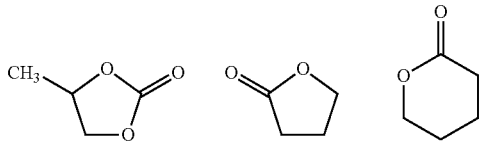

Propylene carbonate γ-Butyrolactone δ-Valerolactone

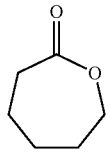

ε-Caprolactone

The content of the compound δ in the surface-layer coating solution is preferably 3 mass % or more and 300 mass % or less with respect to the total mass of the resin α and the resin β. A content of 3 mass % or more and 300 mass % or less is preferred from the viewpoint of a reducing effect on the initial coefficient of friction in the surface of the photosensitive member because an excellent separating action on the resin α and the resin β is obtained. In addition, from the viewpoint of the stability of the surface-layer coating solution, the content of the compound δ in the surface-layer coating solution is preferably 5 mass % or more and 80 mass % or less with respect to the total mass of the resin α and the resin β.

The content of the compound δ in the surface-layer coating solution is preferably 0.5 mass % or more and 150 mass % or less with respect to the total content of the solvent γ. A content of 0.5 mass % or more and 150 mass % or less is preferred from the viewpoints of the reducing effect on the initial coefficient of friction in the surface of the photosensitive member and the effect of the stability of the coating solution. In addition, from the viewpoint of the stability of the surface-layer coating solution, the content of the compound δ in the surface-layer coating solution is preferably 0.5 mass % or more and 40 mass % or less, more preferably 5 mass % or more and 40 mass % or less with respect to the total content of the solvent γ.

<Resin α>

The resin α is at least one resin selected from the group consisting of a polycarbonate resin not having a siloxane moiety at an end thereof, and a polyester resin not having a siloxane moiety at an end thereof.

In the present invention, it is preferred that the polycarbonate resin not having a siloxane moiety at an end thereof be a polycarbonate resin A having a structural unit represented by the following formula (A). It is preferred that the polyester resin not having a siloxane moiety at an end thereof be a polyester resin B having a structural unit represented by the following formula (B).

(A)

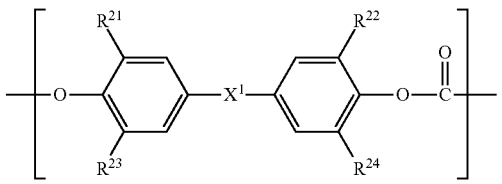

In the formula (A), $R^{21}$ to $R^{24}$ each independently represent a hydrogen atom or a methyl group, $X^1$ represents a single bond, a cyclohexylidene group, or a divalent group having a structure represented by the following formula (C).

(B)

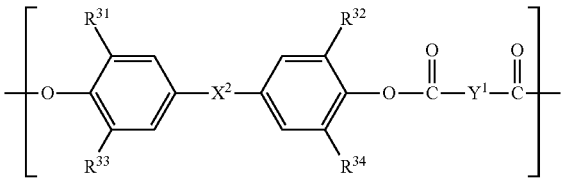

In the formula (B), $R^{31}$ to $R^{34}$ each independently represent a hydrogen atom or a methyl group, $X^2$ represents a single bond, a cyclohexylidene group, or a divalent group having a structure represented by the following formula (C), and $Y^1$ represents an m-phenylene group, a p-phenylene group, or a divalent group in which two p-phenylene groups are bonded through an oxygen atom.

(C)

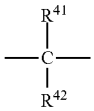

In the formula (C), $R^{41}$ and $R^{42}$ each independently represent a hydrogen atom, a methyl group, or a phenyl group.

Specific examples of the repeating structural unit of the polycarbonate resin A represented by the formula (A) are shown below.

(A-1)

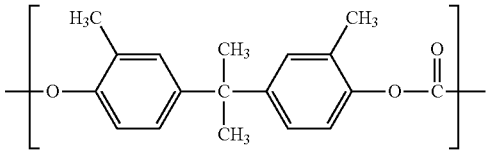

(A-2)

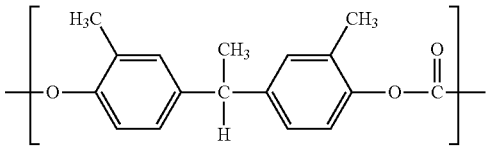

-continued (A-3)

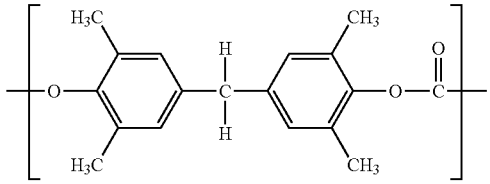

(A-4)

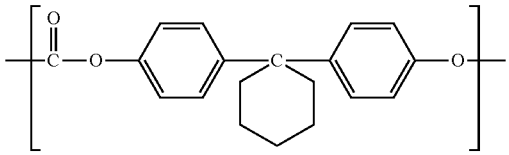

(A-5)

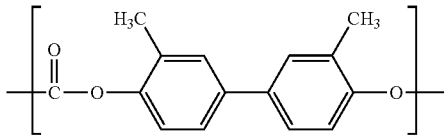

(A-6)

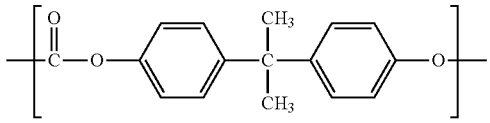

(A-7)

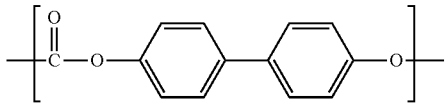

(A-8)

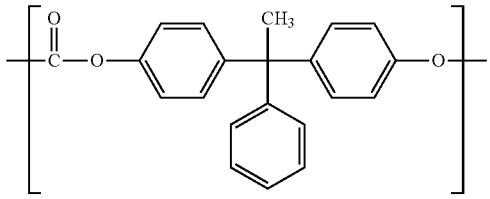

Of those, structural units represented by the formulae (A-1), (A-2), and (A-4) are preferred.

The polycarbonate resin A can be synthesized by, for example, a conventional phosgene method. The resin can also be synthesized by an ester exchange method.

Specific examples of the structural unit of the polyester resin B represented by the formula (B) are shown below.

(B-1)

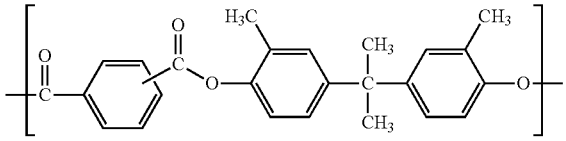

(B-2)

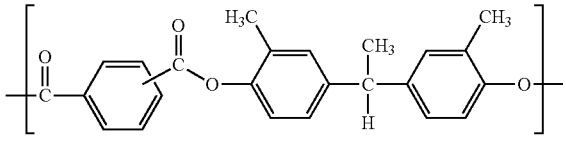

-continued (B-3)

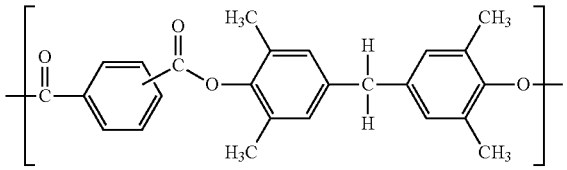

(B-4)

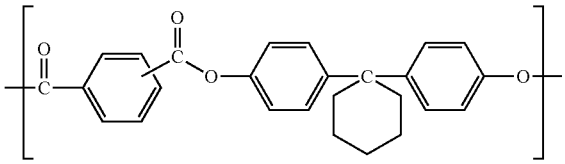

(B-5)

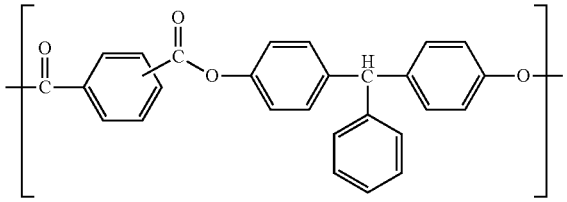

(B-6)

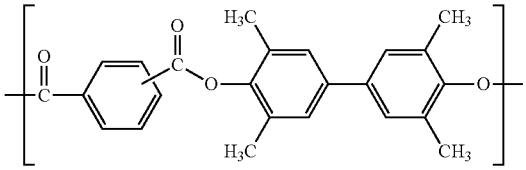

(B-7)

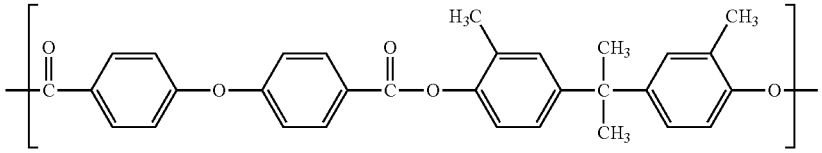

(B-8)

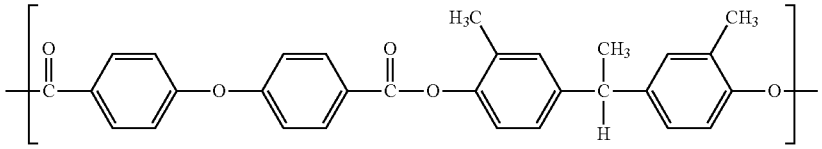

(B-9)

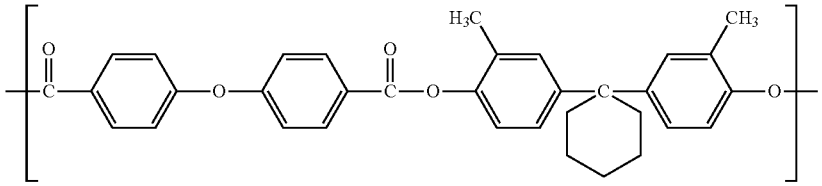

Of those, structural units represented by the formulae (B-1), (B-2), (B-3), (B-6), (B-7), and (B-8) are preferred.

Those polycarbonate resins A and polyester resins B can be synthesized by a known method. For example, those resins can be synthesized by a method disclosed in Japanese Patent Application Laid-Open No. 2007-047655 or Japanese Patent Application Laid-Open No. 2007-072277.

One kind of the polycarbonate resin A and the polyester resin B can be used alone, or two or more kinds thereof can be used as a mixture or a copolymer. Their copolymerization form may be any one of the forms such as block copolymerization, random copolymerization, and alternating copolymerization.

The weight-average molecular weight of each of the polycarbonate resin A and the polyester resin B is preferably 20,000 or more and 300,000 or less, more preferably 50,000 or more and 200,000 or less.

In the present invention, the weight-average molecular weight of each of the resins is a weight-average molecular weight in terms of polystyrene measured according to a conventional method by a method described in Japanese Patent Application Laid-Open No. 2007-079555.

In addition, the polycarbonate resin A and the polyester resin B each serving as the resin α may each be a copolymer having a structural unit including a siloxane moiety in addition to the structural unit represented by the formula (A) or the formula (B). Specific examples thereof include structural units represented by the following formulae (H-1) and (H-2). The copolymer may further have a structural unit represented by the following formula (H-3).

(H-1)

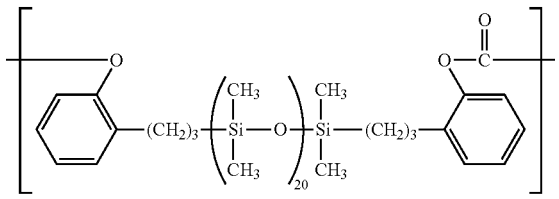

(H-2)

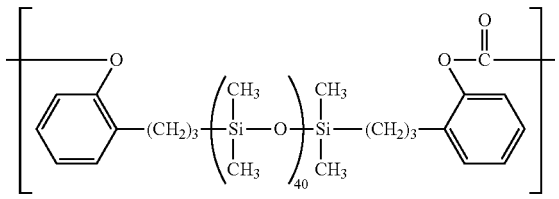

-continued (H-3)

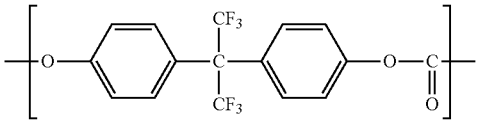

Specific resins each of which is used as the resin α are shown below.

TABLE 1

| Component (α) (polycarbonate resin A/polyester resin B) | Structural unit | Ratio between respective structural units (mass ratio) | Weight-average molecular weight (Mw) |
|---|---|---|---|
| Resin A (1) | (A-4) | — | 55,000 |
| Resin A (2) | (A-4) | — | 14,000 |
| Resin A (3) | (A-4) | — | 110,000 |
| Resin A (4) | (A-6) | — | 55,000 |
| Resin A (5) | (A-1) | — | 54,000 |
| Resin A (6) | (A-6)/(A-1) | 6.5/3.5 | 55,000 |
| Resin A (7) | (A-4)/(H-1) | 9/1 | 55,000 |
| Resin A (8) | (A-4)/(H-1) | 9/1 | 110,000 |
| Resin A (9) | (A-4)/(H-1)/(H-3) | 6/1.5/2.5 | 60,000 |
| Resin B (1) | (B-1) | — | 120,000 |
| Resin B (2) | (B-1)/(B-6) | 7/3 | 120,000 |
| Resin B (3) | (B-8) | — | 100,000 |

In Table 1, with regard to the structural units represented by the formulae (B-1) and (B-6) in the resin B(1) and the resin B(2), the molar ratio (terephthalic acid skeleton/isophthalic acid skeleton) of a terephthalic acid structure to an isophthalic acid structure is 5/5.

<Resin β>

The resin β is at least one resin selected from the group consisting of a polycarbonate resin having a siloxane moiety at an end thereof, a polyester resin having a siloxane moiety at an end thereof, and a polyacrylate resin having a siloxane moiety at an end thereof.

In the present invention, when a resin having a siloxane moiety at an end thereof is used, the surface of the photosensitive member has high lubricity and hence its initial coefficient of friction can be reduced. This is probably because the presence of a dimethylpolysiloxane moiety at an end increases the degree of freedom of a siloxane moiety and hence improves the surface migration property of the resin.

The resins each having a siloxane moiety at an end thereof in the resin β are a polycarbonate resin, a polyester resin, and a polyacrylate resin from the viewpoints of compatibility with the resin α, and the stability and coatability of the coating solution.

In the present invention, it is preferred that the polycarbonate resin having a siloxane moiety at an end thereof be a polycarbonate resin D having a structural unit represented by the following formula (A') and an end structure represented by the following formula (D). In addition, it is preferred that the polyester resin having a siloxane moiety at an end thereof be a polyester resin E having a structural unit represented by the following formula (B') and an end structure represented by the following formula (D).

(A')

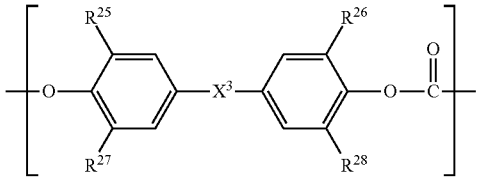

In the formula (A'), $R^{25}$ to $R^{28}$ each independently represent a hydrogen atom or a methyl group, and $X^3$ represents a single bond, a cyclohexylidene group, or a divalent group having a structure represented by the following formula (C').

(B')

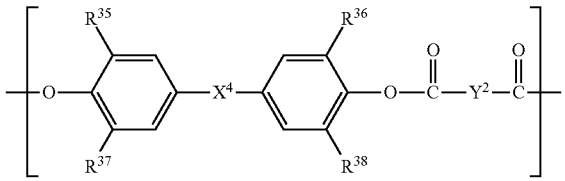

In the formula (B'), $R^{35}$ to $R^{38}$ each independently represent a hydrogen atom or a methyl group, $X^4$ represents a single bond, a cyclohexylidene group, or a divalent group having a structure represented by the following formula (C'), and $Y^2$ represents an m-phenylene group, a p-phenylene group, or a divalent group in which two p-phenylene groups are bonded through an oxygen atom.

(C')

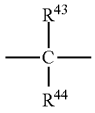

In the formula (C'), $R^{43}$ and $R^{44}$ each independently represent a hydrogen atom, a methyl group, or a phenyl group.

(D)

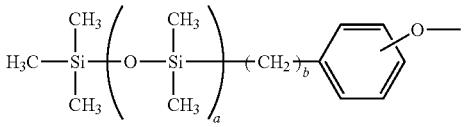

In the formula (D), a and b each independently represent the repetition number of a structure in respective parentheses, and the average value of a for the polycarbonate resin D or the polyester resin E is 20 or more and 100 or less, and the average value of b therefor is 1 or more and 10 or less. It is more preferred that the average value of a be 30 or more and 60 or less, and the average value of b be 3 or more and 10 or less.

In the present invention, the polycarbonate resin D and the polyester resin E each have the end structure represented by the formula (D) at one end, or each of both ends, of the resin. When any such resin has the end structure represented by the formula (D) at one end thereof, a molecular weight modifier (an end stopping agent) is used. Examples of the molecular weight modifier include phenol, p-cumylphenol, p-tert-butylphenol, and benzoic acid. In the present invention, phenol or p-tert-butylphenol is preferred.

When any such resin has the end structure represented by the formula (D) at one end thereof, a structure at the other end thereof (other end structure) is a structure shown below.

(G-1)

(G-2)

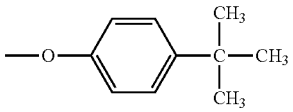

Specific examples of the end structure represented by the formula (D) are shown below.

(D-1)

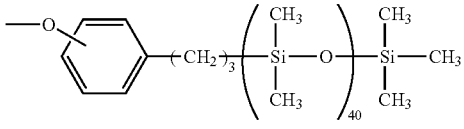

(D-2)

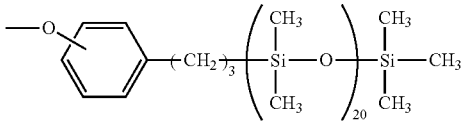

(D-3)

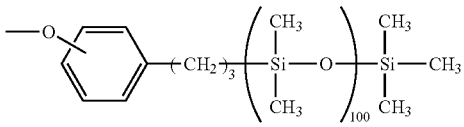

(D-4)

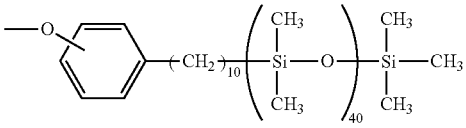

(D-5)

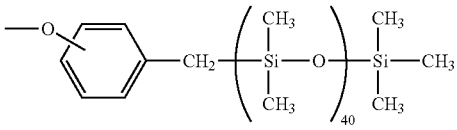

One kind of the polycarbonate resin D and the polyester resin E can be used alone, or two or more kinds thereof can be used as a mixture or a copolymer. Their copolymerization form may be any one of the forms such as block copolymerization, random copolymerization, and alternating copolymerization. In addition, a structural unit having a siloxane moiety may be present in the main chain of each of the polycarbonate resin D and the polyester resin E. For example, a copolymer having a structural unit represented by the following formula (H) is permitted.

(H)

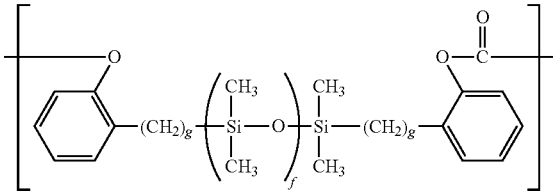

In the formula (H), f and g each represent the repetition number of a structure in parentheses, and the average value of f for the polycarbonate resin D and the polyester resin E is 20 or more and 100 or less, and the average value of g therefor is 1 or more and 10 or less. Specific examples of the structural unit represented by the formula (H) include the structural units represented by the formulae (H-1) and (H-2).

Specific examples of the structural unit represented by the formula (A') in the polycarbonate resin D include the structural units represented by the formulae (A-1) to (A-8). Of those, the structural units represented by the formulae (A-1), (A-2), and (A-4) are preferred. Specific examples of the structural unit represented by the formula (B') in the polyester resin E include the structural units represented by the formulae (B-1) to (B-9). Of those, the structural units represented by the formulae (B-1), (B-3), (B-6), (B-7), and (B-8) are preferred. Of those, the structural units represented by the formulae (A-4), (B-1), and (B-3) are particularly preferred.

In the present invention, the siloxane moiety of each of the polycarbonate resin D and the polyester resin E refers to a structure in a frame indicated by a dotted line in an end structure represented by the following formula (D-S). Further, when the polycarbonate resin D and the polyester resin E each have the structural unit represented by the formula (H), a structure in a frame indicated by a dotted line in a structural unit represented by the following formula (H—S) is also included in the category of the siloxane moiety.

(D-S)

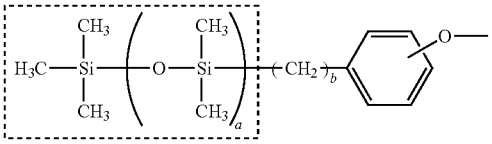

(H-S)

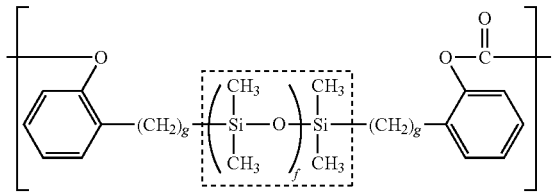

In the present invention, the polycarbonate resin D and the polyester resin E can be synthesized by a known method. For example, the resins can be synthesized by a method described in Japanese Patent Application Laid-Open No. 2007-199688. In the present invention as well, the polycarbonate resin D and the polyester resin E shown in the synthesis examples of Table 2 were synthesized by employing the same synthesis method with raw materials corresponding to the polycarbonate resin D and the polyester resin E. It should be noted that the purification of each of the polycarbonate resin D and the polyester resin E was performed as described below. After fractionation and separation had been performed by employing size exclusion chromatography, each fractionated component was subjected to $^{1}$H-NMR measurement and then resin composition was determined from the relative ratio of the siloxane moiety in the resin. Table 2 shows the weight-average molecular weights of the synthesized polycarbonate resin D and polyester resin E, and the contents of their siloxane moieties.

Specific examples of the polycarbonate resin D and the polyester resin E are described below.

TABLE 2

| (β) (polycarbonate resin D/polyester resin E) | Structural unit of main chain | End siloxane moiety | Other end structure | Content of siloxane moiety (mass %) | Weight-average molecular weight (Mw) |
|---|---|---|---|---|---|
| Resin D (1) | (A-4) | (D-1) | — | 23% | 50,000 |
| Resin D (2) | (A-2) | (D-5) | — | 25% | 48,000 |
| Resin D (3) | (A-4)/(H-2) | (D-1) | — | 32% | 54,000 |
| Resin D (4) | (A-4) | (D-1) | (G-1) | 13% | 48,000 |
| Resin D (5) | (A-4) | (D-1) | (G-2) | 12% | 49,000 |
| Resin E (1) | (B-1) | (D-1) | — | 22% | 42,000 |

In Table 2, a mass ratio "(A-4):(H-2)" between the respective structural units of the main chain in the resin D(3) is 9:1.

In the present invention, the polyacrylate resin having a siloxane moiety at an end thereof is preferably a polyacrylate resin F having an end structure represented by the following formula (F-1) and a structural unit represented by the following formula (F-2), or having an end structure represented by the following formula (F-1) and a structural unit represented by the following formula (F-3).

(F-1)

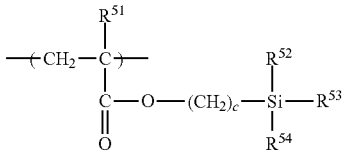

In the formula (F-1), $R^{51}$ represents a hydrogen atom or a methyl group, c represents the repetition number of a structure in a parenthesis, and the average value of c for the polyacrylate resin F is 0 or more and 5 or less, and $R^{52}$ to $R^{54}$ each independently represent a structure represented by the following formula (F-1-2), a methyl group, a methoxy group, or a phenyl group, and at least one of $R^{52}$ to $R^{54}$ has a structure represented by the following formula (F-1-2).

(F-1-2)

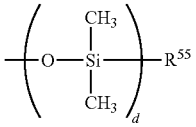

In the formula (F-1-2), d represents the repetition number of a structure in a parenthesis, and the average value of d for the polyacrylate resin F is 10 or more and 50 or less, and $R^{55}$ represents a hydroxy group or a methyl group.

(F-2)

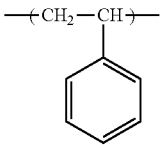

(F-3)

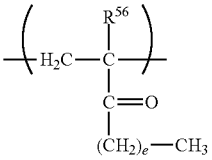

In the formula (F-3), $R^{56}$ represents a hydrogen atom, a methyl group, or a phenyl group, and e represents 0 or 1.

In the present invention, the siloxane moiety of the polyacrylate resin F refers to a structure in a frame indicated by a dotted line in a structure represented by the following formula (F-S) or the following formula (F-T).

(F-S)

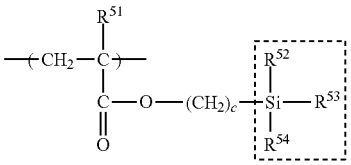

(F-T)

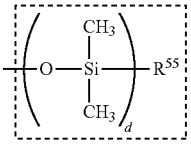

Table 3 below shows specific examples of the structural units of the polyacrylate resin F.

TABLE 3

| Compound Example | (F-1) | (F-2) or (F-3) | Weight ratio between structural units | Weight-average molecular weight Mw |
|---|---|---|---|---|
| F-A | 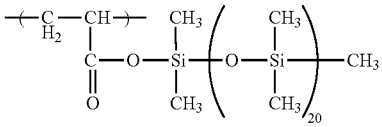 | 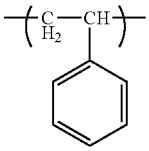 | 2/8 | 105,000 |

TABLE 3-continued

| Compound Example | (F-1) | (F-2) or (F-3) | Weight ratio between structural units | Weight-average molecular weight Mw |
|---|---|---|---|---|
| F-B | 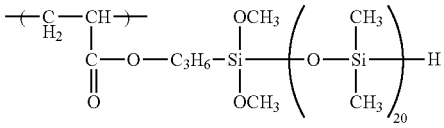 | 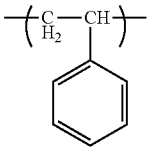 | 2/8 | 100,000 |
| F-C | 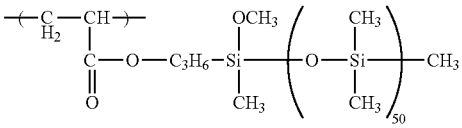 | 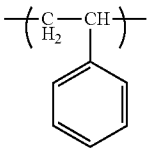 | 1/9 | 100,000 |
| F-D | 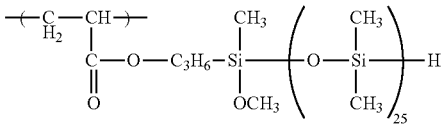 | 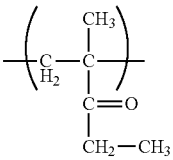 | 1/9 | 105,000 |
| F-E | 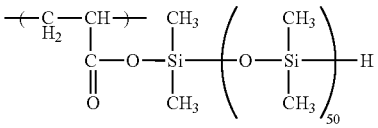 | 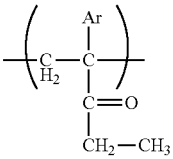 | 2/8 | 110,000 |
| F-F | 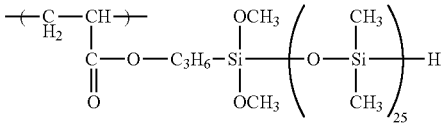 | 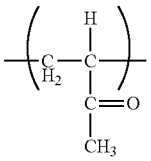 | 1.5/8.5 | 100,000 |
| F-G | 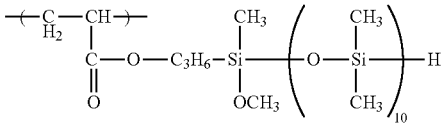 | 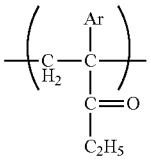 | 1/9 | 110,000 |

Of the polyacrylate resins F shown in Table 3, resins represented by Compound Examples (F-B) and (F-D) are preferred.

Those polyacrylate resins can be synthesized by a known method. For example, the resins can be synthesized by a method described in Japanese Patent Application Laid-Open No. S58-167606 or Japanese Patent Application Laid-Open No. S62-075462.

The content of the resin β in the surface-layer coating solution is preferably 0.1 mass % or more and 50 mass % or less with respect to the content of the resin α. When the content is 0.1 mass % or more and 50 mass % or less, the reducing effect on the initial coefficient of friction is sufficiently exerted.

<Solvent γ>

In the surface-layer coating solution of the present invention, the solvent γ is at least one solvent selected from the group consisting of toluene and xylene. Specific examples thereof include toluene (boiling point: 111° C.), o-xylene (boiling point: 144° C.), m-xylene (boiling point: 139° C.), p-xylene (boiling point: 138° C.), and mixed xylene (boiling point: 138 to 144° C.). Of those, o-xylene is preferred. One of those solvents may be used alone, or two or more thereof may be used as a mixture. It should be noted that a numerical value in parentheses represents a boiling point in one atmosphere.

The surface-layer coating solution for an electrophotographic photosensitive member in the present invention, which contains at least one of toluene and xylene, may further contain any other solvent for forming a surface layer having a uniform thickness. The coating solution preferably contains a chain ether or cyclic ether having a low boiling point as the other solvent. The chain ether having a low boiling point is, for example, dimethoxymethane, and the cyclic ether having a low boiling point is, for example, tetrahydrofuran (THF). At least one of dimethoxymethane and tetrahydrofuran (hereinafter sometimes referred to as "(ϵ)") is preferably used. In this case, it is preferred that with respect to the total mass of a liquid obtained by summing the solvent γ, the compound δ, and the (ϵ), the content of the solvent γ be 15 mass % or more and 99 mass % or less, the content of the compound δ be 0.5 mass % or more and 35 mass % or less, and the content of the (ϵ) be 0.1 mass % or more and 65 mass % or less.

Next, the construction of an electrophotographic photosensitive member of the present invention is described.

The electrophotographic photosensitive member of the present invention includes a support and a photosensitive layer formed on the support. In addition, examples of the photosensitive layer include such a single layer type photosensitive layer that a charge-transporting substance and a charge-generating substance are incorporated into the same layer, and a laminated type (separated-function type) photosensitive layer separated into a charge-generating layer containing the charge-generating substance and a charge-transporting layer containing the charge-transporting substance. In the present invention, the laminated type photosensitive layer is preferred. In addition, the charge-generating layer may be of a laminated structure, or the charge-transporting layer may be of a laminated structure. In addition, a protective layer may be formed on the photosensitive layer for the purpose of improving the durability of the electrophotographic photosensitive member.

With regard to the surface layer of the electrophotographic photosensitive member in the present invention, when the charge-transporting layer is the outermost surface, the charge-transporting layer is the surface layer, and when the protective layer is provided on the charge-transporting layer, the protective layer is the surface layer.

(Support)

The support is one having conductivity (conductive support). For example, the support is one made of a metal such as aluminum, an aluminum alloy, stainless steel, copper, nickel, or zinc, or an alloy thereof. In the case of a support made of aluminum or an aluminum alloy, the support to be used may be an ED tube or an EI tube or one obtained by subjecting the tube to cutting, electrolytic compound polishing (electrolysis with an electrolyte solution and electrodes having an electrolytic action, and polishing with a grinding stone having a polishing action), or a wet- or dry-honing process. Further examples thereof include a support made of a metal or a resin having formed thereon a thin film of a conductive material such as aluminum, an aluminum alloy, or an indium oxide-tin oxide alloy.

In addition, a support obtained by impregnating conductive particles such as carbon black, tin oxide particles, titanium oxide particles, or silver particles in a resin or the like, or a plastic containing a conductive binder resin may be used.

For the purpose of, for example, preventing an interference pattern formed due to scattering of a laser beam or the like, the surface of the conductive support may be subjected to, for example, cutting treatment, roughening treatment, or alumite treatment.

In the electrophotographic photosensitive member of the present invention, a conductive layer containing conductive particles and a resin may be provided on the support. The conductive layer is a layer formed by using a conductive-layer coating solution in which conductive particles are dispersed in a binder resin.

Examples of the conductive particles include carbon black, acetylene black, metal powders made of, for example, aluminum, nickel, iron, nichrome, copper, zinc, and silver, and metal oxide powders made of, for example, conductive tin oxide and ITO.

Examples of the binder resin to be used in the conductive layer include a polyester resin, a polycarbonate resin, a polyvinyl butyral resin, a polyacrylate resin, a silicone resin, an epoxy resin, a melamine resin, a urethane resin, a phenol resin, and an alkyd resin.

As a solvent for the conductive-layer coating solution, for example, there are given an ether-based solvent, an alcohol-based solvent, a ketone-based solvent, and an aromatic hydrocarbon solvent. The thickness of the conductive layer is preferably 0.2 μm or more and 40 μm or less, more preferably 1 μm or more and 35 μm or less, still more preferably 5 μm or more and 30 μm or less.

An intermediate layer may be provided between the conductive support or the conductive layer and the photosensitive layer. The intermediate layer is formed for improving the adhesiveness of the photosensitive layer, improving the coatability, improving the property relative to charge injection from the conductive support, and protecting the photosensitive layer from an electrical breakdown.

The intermediate layer can be formed by applying an intermediate-layer coating solution containing a binder resin onto the conductive support or the conductive layer, and then drying or curing the coating solution.

Examples of the binder resin of the intermediate layer include polyacrylic acids, methylcellulose, ethylcellulose, a polyamide resin, a polyimide resin, a polyamideimide resin, a polyamide acid resin, a melamine resin, an epoxy resin, and a polyurethane resin. The binder resin to be used in the intermediate layer is preferably a thermoplastic resin, and specifically, a thermoplastic polyamide resin is preferred. The polyamide resin is preferably copolymer nylon with low crystallinity or amorphous which can be applied in a solution state.

As a solvent for the intermediate-layer coating solution, there are given an ether-based solvent, an alcohol-based solvent, a ketone-based solvent, and an aromatic hydrocarbon solvent. The thickness of the intermediate layer is preferably 0.05 μm or more and 40 μm or less, more preferably 0.1 μm or more and 30 μm or less. In addition, the intermediate layer may further contain semiconductive particles, an electron-transporting substance, or an electron-accepting substance.

(Photosensitive Layer)

The photosensitive layer (charge-generating layer, charge-transporting layer) is formed on the conductive support, conductive layer, or intermediate layer.

Examples of the charge-generating substance to be used in the electrophotographic photosensitive member of the present invention include azo pigments, phthalocyanine pigments, indigo pigments, and perylene pigments. Only one of those charge-generating substances may be used, or two or more thereof may be used. Of those, oxytitanium phthalocyanine, hydroxygallium phthalocyanine, chlorogallium phthalocyanine, and the like are particularly preferred because of their high sensitivity.

Examples of the binder resin to be used in the charge-generating layer include a polycarbonate resin, a polyester resin, a butyral resin, a polyvinyl acetal resin, a polyacrylate resin, a vinyl acetate resin, and a urea resin. Of those, a butyral resin is particularly preferred. One of those resins may be used alone, or two or more thereof may be used as a mixture or as a copolymer.

The charge-generating layer can be formed by applying a charge-generating-layer coating solution, which is prepared by dispersing the charge-generating substance together with the binder resin and a solvent, and then drying the coating solution. Further, the charge-generating layer may be a deposited film of a charge-generating substance.

An example of the dispersion method is one using a homogenizer, an ultrasonic wave, a ball mill, a sand mill, an attritor, or a roll mill.

A ratio between the charge-generating substance and the binder resin is preferably 0.1 part by mass or more and 10 parts by mass or less, more preferably 1 part by mass or more and 3 parts by mass or less of the charge-generating substance with respect to 1 part by mass of the resin.

Examples of the solvent to be used in the charge-generating-layer coating solution include an alcohol-based solvent, a sulfoxide-based solvent, a ketone-based solvent, an ether-based solvent, an ester-based solvent, and an aromatic hydrocarbon solvent.

The thickness of the charge-generating layer is preferably 0.01 μm or more and 5 μm or less, more preferably 0.1 μm or more and 2 μm or less.

Further, any of various sensitizers, antioxidants, UV absorbents, plasticizers, and the like may be added to the charge-generating layer, if required. An electron-transporting substance or an electron-accepting substance may also be added to the charge-generating layer to prevent the flow of charge (carrier) from being disrupted in the charge-generating layer.

In the electrophotographic photosensitive member including the laminated type photosensitive layer, the charge-transporting layer is formed on the charge-generating layer.

For example, a triarylamine compound, a hydrazone compound, a styryl compound, and a stilbene compound are given as the charge-transporting substance to be used in the present invention. A compound represented by any one of the following structural formulae (CTM-1) to (CTM-7) is preferred.

(CTM-1)

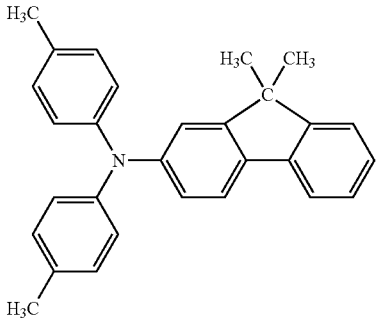

(CTM-2)

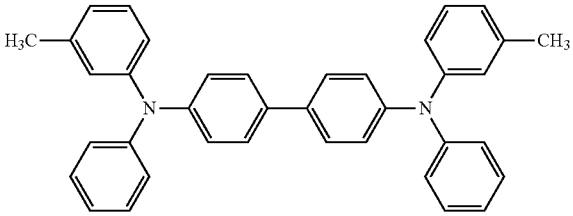

(CTM-3)

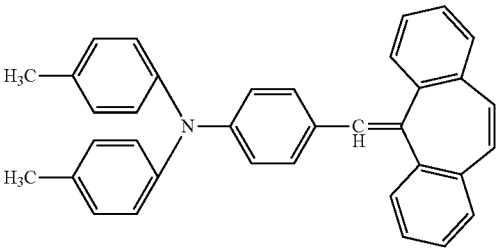

-continued (CTM-4)

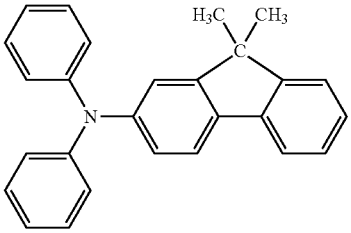

(CTM-5)

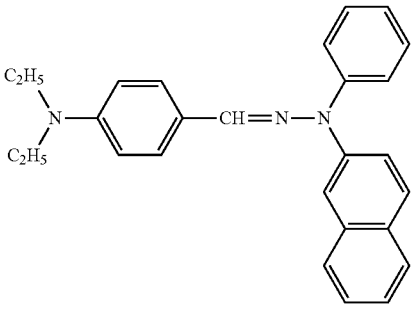

(CTM-6)

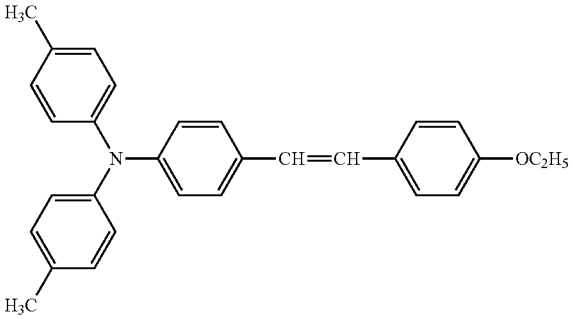

(CTM-7)

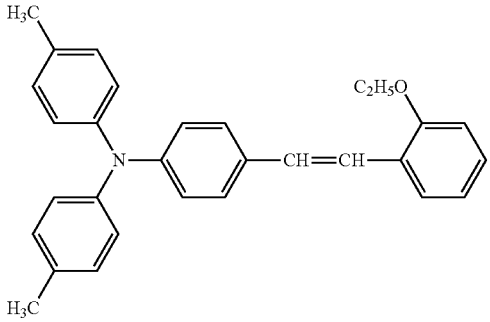

The charge-transporting layer can be formed by applying a charge-transporting-layer coating solution obtained by dissolving the charge-transporting substance and a binder resin in a solvent, and then drying the coating solution.

In the present invention, when the charge-transporting layer is the surface layer, the resin α and the resin β are contained as binder resins; any other resin may be further mixed therein before use. The other resin that may be mixed before use is as described above.

When the surface layer of the electrophotographic photosensitive member of the present invention is the charge-transporting layer, the charge-transporting-layer coating solution (surface-layer coating solution), which contains the solvent γ and the compound δ, may further contain any other solvent as described above.

A ratio between the charge-transporting substance and the binder resins is as follows: the amount of the charge-transporting substance is preferably 0.3 part by mass or more and 2 parts by mass or less, more preferably 0.5 part by mass or more and 1.5 parts by mass or less per 1 part by mass of the binder resins.

The charge-transporting layer has a thickness of preferably 5 μm or more and 50 μm or less, more preferably 10 μm or more and 35 μm or less.

A variety of additives may be added to each layer of the electrophotographic photosensitive member of the present invention. Examples of the additives include: an antidegradant such as an antioxidant, a UV absorbent, or a light stabilizer; and fine particles such as organic fine particles or inorganic fine particles.

Examples of the antidegradant include a hindered phenol-based antioxidant, a hindered amine-based light stabilizer, a sulfur atom-containing antioxidant, and a phosphorus atom-containing antioxidant.

Examples of the organic fine particles include polymer resin particles such as fluorine atom-containing resin particles, polystyrene fine particles, and polyethylene resin particles. Examples of the inorganic fine particles include metal oxides such as silica and alumina.

For the application of each of the coating solutions for the respective layers, any of the application methods can be employed, such as dip coating, spraying coating, spinner coating, roller coating, Mayer bar coating, and blade coating. Of those, the dip coating method is preferred.

The drying temperature at which the coating solution for each layer is dried to form a coat is as follows: the coating solution is preferably dried at 60° C. or more and 160° C. or less. The drying temperature for the charge-transporting-layer coating solution (surface-layer coating solution) is particularly preferably 110° C. or more and 140° C. or less out of such range.

(Electrophotographic Apparatus)

FIGURE illustrates an example of the schematic construction of an electrophotographic apparatus including a process cartridge having the electrophotographic photosensitive member of the present invention.

In FIGURE, a cylindrical electrophotographic photosensitive member 1 is driven to rotate around an axis in the direction indicated by the arrow at a predetermined peripheral speed. The surface of the electrophotographic photosensitive member 1 driven to rotate is uniformly charged to a predetermined negative potential by a charging device (primary charging device: such as a charging roller) 3 during the process of rotation. Subsequently, the surface of the electrophotographic photosensitive member 1 receives exposure light (image exposure light) 4 which is emitted from an exposing device (not shown) such as slit exposure or laser-beam scanning exposure and is intensity-modulated according to a time-series electric digital image signal of image information of interest. In this way, electrostatic latent images corresponding to images of interest are sequentially formed on the surface of the electrophotographic photosensitive member 1.

The electrostatic latent images formed on the surface of the electrophotographic photosensitive member 1 are converted into toner images by reversal development with toner contained in a developer of a developing device 5. Subsequently, the toner images being formed and carried on the surface of the electrophotographic photosensitive member 1 are sequentially transferred to a transfer material (such as paper) P by a transfer bias from a transferring device (such as transfer roller) 6. It should be noted that the transfer material P is taken from a transfer material supplying device (not shown) in synchronization with the rotation of the electrophotographic photosensitive member 1 and then fed to a portion (abutment part) between the electrophotographic photosensitive member 1 and the transferring device 6. Further, bias voltage having a polarity reverse to that of the electric charges of the toner is applied to the transferring device 6 from a bias power source (not shown).

The transfer material P which has been transferred to the toner images is separated from the surface of the electrophotographic photosensitive member 1 and then introduced to a fixing device 8. The transfer material P is subjected to an image fixation of the toner images and then printed as an image-formed product (print or copy) out of the apparatus.

The surface of the electrophotographic photosensitive member 1 after the transfer of the toner images is cleaned by removal of the residual developer after the transfer (transfer residual toner) by a cleaning device (such as cleaning blade) 7. Subsequently, the surface of the electrophotographic photosensitive member 1 is subjected to a neutralization process with pre-exposure light (not shown) from a pre-exposing device (not shown) and then repeatedly used in image formation. It should be noted that, as illustrated in FIGURE, when the charging device 3 is a contact-charging device using a charging roller or the like, the pre-exposure is not always required.

In the present invention, the electrophotographic photosensitive member 1 and multiple components selected from, for example, the charging device 3, the developing device 5, the transferring device 6, and the cleaning device 7 may be stored in a container and integrally supported to form a process cartridge. The process cartridge may be detachably mountable to the main body of an electrophotographic apparatus. In addition, the process cartridge may be detachably mountable to the main body of an electrophotographic apparatus such as a copying machine or a laser beam printer. In FIGURE, the charging device 3, the developing device 5, and the cleaning device 7 are integrally supported with the electrophotographic photosensitive member 1 to form a cartridge. Then, the cartridge is used as a process cartridge 9 detachably mountable to the main body of the electrophotographic apparatus with a guiding device 10 such as a rail of the main body of the electrophotographic apparatus.

EXAMPLES

Hereinafter, the present invention is described in more detail with reference to specific examples. However, the present invention is not limited thereto. In addition, "part(s)" means "part(s) by mass" in the examples.

Example 1

An aluminum cylinder with a diameter of 30 mm and a length of 260.5 mm was used as a support (conductive support).

Next, 12 parts of $SnO_2$-coated barium sulfate (conductive particle), 3 parts of titanium oxide (pigment for controlling resistance), 6 parts of a phenol resin (binder resin), 0.001 part of silicone oil (leveling agent), and a mixed solvent of 4 parts of methanol and 16 parts of methoxypropanol were used to prepare a conductive-layer coating solution.

The conductive-layer coating solution was applied onto the support by dip coating and cured (thermally cured) at 140° C. for 30 minutes, to thereby form a conductive layer having a thickness of 25 μm.

Next, 3 parts of N-methoxymethylated nylon and 3 parts of copolymer nylon were dissolved in a mixed solvent of 65 parts of methanol and 30 parts of n-butanol, to thereby prepare an intermediate-layer coating solution.

The intermediate-layer coating solution was applied onto the conductive layer by dip coating and dried at 100° C. for 10 minutes, to thereby form an intermediate layer having a thickness of 0.7 μm.

Next, 10 parts of a hydroxygallium phthalocyanine crystal (charge-generating substance) in a crystal form having strong peaks at Bragg angles (2θ±0.2°) in CuKα-characteristic X-ray diffraction of 7.5°, 9.9°, 16.3°, 18.6°, 25.1°, and 28.3° were added to a solution by dissolving 5 parts of a polyvinyl butyral resin (product name: S-LEC BX-1, manufactured by Sekisui Chemical Co., Ltd., binder resin) in 250 parts of cyclohexanone. The resultant mixture was dispersed by a sand mill apparatus using glass beads each having a diameter of 1 mm under a 23±3° C. atmosphere for 1 hour. After the dispersion, 250 parts of ethyl acetate were added thereto to prepare a charge-generating-layer coating solution.

The charge-generating-layer coating solution was applied onto the intermediate layer by dip coating and dried at 100° C. for 10 minutes, to thereby form a charge-generating layer having a thickness of 0.22 μm.

Next, 5.6 parts of the compound represented by the formula (CTM-1) (charge-transporting substance), 2.4 parts of the compound represented by the formula (CTM-2) (charge-transporting substance), 10 parts of the polycarbonate resin A(1) (resin (A1)), and 0.36 part of the polycarbonate resin D(1) (resin (D1)) were dissolved in a mixed solvent of 30 parts of o-xylene, 20 parts of dimethoxymethane, and 2.5 parts of propylene carbonate to prepare a charge-transporting-layer coating solution.

The charge-transporting-layer coating solution was applied onto the charge-generating layer by dip coating to form a coat, and then the coat was dried at 125° C. for 30 minutes to form a charge-transporting layer having a thickness of 15 μm. Thus, an electrophotographic photosensitive member was produced.

Examples 2 and 3

Electrophotographic photosensitive members were each produced in the same manner as in Example 1 except that in Example 1, the drying temperature in the formation of the charge-transporting layer was changed to 115° C. or 135° C.

Examples 4 and 5

Electrophotographic photosensitive members were each produced in the same manner as in Example 1 except that in Example 1, the thickness of the charge-transporting layer was changed to 10 μm or 30 μm.

Examples 6 to 10

Electrophotographic photosensitive members were each produced in the same manner as in Example 1 except that in Example 1, the solvent γ was changed as shown in Table 4.

Example 11

An electrophotographic photosensitive member was produced in the same manner as in Example 6 except that in Example 6, dimethoxymethane as the (ϵ) was changed to tetrahydrofuran (THF).

Example 12

An electrophotographic photosensitive member was produced in the same manner as in Example 1 except that in Example 1, as shown in Table 4, dimethoxymethane was not used and the content of o-xylene was changed to 50 parts.

Example 13

An electrophotographic photosensitive member was produced in the same manner as in Example 1 except that in Example 1, as shown in Table 4, the content of o-xylene was changed to 20 parts and the content of dimethoxymethane was changed to 30 parts.

Examples 14 to 17

Electrophotographic photosensitive members were each produced in the same manner as in Example 1 except that in Example 1, the compound δ was changed as shown in Table 4.

Examples 18 and 19

Electrophotographic photosensitive members were each produced in the same manner as in Example 1 except that in Example 1, the content of the resin (D1) was changed as shown in Table 4.

Example 20

An electrophotographic photosensitive member was produced in the same manner as in Example 1 except that in Example 1, the content of propylene carbonate was changed as shown in Table 4.

Example 21

An electrophotographic photosensitive member was produced in the same manner as in Example 1 except that in Example 1, as shown in Table 4, the content of o-xylene was changed to 28 parts, the content of propylene carbonate was charged to 8 parts, and the content of dimethoxymethane was changed to 18 parts.

Examples 22 and 23

Electrophotographic photosensitive members were each produced in the same manner as in Example 1 except that in Example 1, the content of the resin (D1) and the content of propylene carbonate were changed as shown in Table 4.

Examples 24 to 28 and 30 to 79

Electrophotographic photosensitive members were each produced in the same manner as in Example 1 except that in Example 1, the kinds and contents of the resin α, the resin β, the solvent γ, the compound δ, the charge-transporting substances, and the (ϵ) were changed as shown in Tables 4 to 6.

Example 29

An electrophotographic photosensitive member was produced in the same manner as in Example 1 except that in Example 28, the thickness of the charge-transporting layer was changed to 10 μm and the drying temperature in the formation of the charge-transporting layer was changed to 115° C.

Examples 80 and 81

Electrophotographic photosensitive members were each produced in the same manner as in Example 1 except that in Example 1, 0.8 part of a compound represented by the following formula (AD-1) and 0.2 part of a compound represented by the following formula (AD-2) were contained as additives, and the kinds and contents of the resin α, the resin β, the solvent γ, the compound δ, the charge-transporting substances, and the (ϵ) were changed as shown in Table 6.

(AD-1)

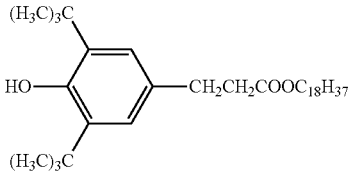

(AD-2)

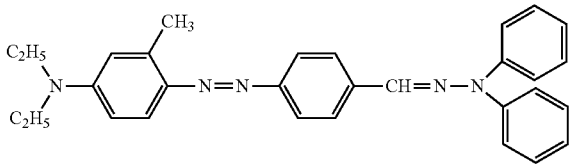

Examples 82 to 85

Electrophotographic photosensitive members were each produced in the same manner as in Example 1 except that in Example 1, the kinds and contents of the resin α, the resin β, the solvent γ, the compound δ, the charge-transporting substances, and the (ϵ) were changed as shown in Table 6.

Comparative Examples 1 to 7

Electrophotographic photosensitive members were each produced in the same manner as in Example 1 except that in Example 1, the compound δ was not contained, or was changed to diisobutyl ketone or n-pentyl acetate, and the kinds and contents of the resin β, the solvent γ, and the (ϵ) were changed as shown in Table 7. It should be noted that diisobutyl ketone and n-pentyl acetate are comparative compounds of the compound δ.

Comparative Examples 8 to 24

Electrophotographic photosensitive members were each produced in the same manner as in Example 1 except that in Example 1, the kinds and contents of the resin α, the resin β, the solvent γ, the compound δ, the charge-transporting substances, and the (ϵ) were changed as shown in Table 7.

Comparative Example 25

An electrophotographic photosensitive member was produced in the same manner as in Example 80 except that in Example 80, the compound δ was not contained as shown in Table 7.

Comparative Examples 26 to 28

Electrophotographic photosensitive members were each produced in the same manner as in Example 1 except that the following change was performed: in Example 1, as shown in Table 7, the resin β was changed to a dimethyl silicone oil (manufactured by Shin-Etsu Chemical Co., Ltd., KF-96-100cs), and the compound δ was not contained in Comparative Example 26, or the solvent γ was changed to chlorobenzene (monochlorobenzene) and the compound δ was not contained in Comparative Example 27.

TABLE 4

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 1 | Resin A(1) | 10 | Resin D(1) | 0.36 | CTM-1/CTM-2 | 5.6/2.4 | o-Xylene | 30 |
| 2 | Resin A(1) | 10 | Resin D(1) | 0.36 | CTM-1/CTM-2 | 5.6/2.4 | o-Xylene | 30 |
| 3 | Resin A(1) | 10 | Resin D(1) | 0.36 | CTM-1/CTM-2 | 5.6/2.4 | o-Xylene | 30 |
| 4 | Resin A(1) | 10 | Resin D(1) | 0.36 | CTM-1/CTM-2 | 5.6/2.4 | o-Xylene | 30 |
| 5 | Resin A(1) | 10 | Resin D(1) | 0.36 | CTM-1/CTM-2 | 5.6/2.4 | o-Xylene | 30 |
| 6 | Resin A(1) | 10 | Resin D(1) | 0.36 | CTM-1/CTM-2 | 5.6/2.4 | Toluene | 30 |
| 7 | Resin A(1) | 10 | Resin D(1) | 0.36 | CTM-1/CTM-2 | 5.6/2.4 | m-Xylene | 30 |
| 8 | Resin A(1) | 10 | Resin D(1) | 0.36 | CTM-1/CTM-2 | 5.6/2.4 | p-Xylene | 30 |
| 9 | Resin A(1) | 10 | Resin D(1) | 0.36 | CTM-1/CTM-2 | 5.6/2.4 | o-Xylene/ Toluene | 15/15 |
| 10 | Resin A(1) | 10 | Resin D(1) | 0.36 | CTM-1/CTM-2 | 5.6/2.4 | Mixed xylene | 30 |
| 11 | Resin A(1) | 10 | Resin D(1) | 0.36 | CTM-1/CTM-2 | 5.6/2.4 | Toluene | 30 |
| 12 | Resin A(1) | 10 | Resin D(1) | 0.36 | CTM-1/CTM-2 | 5.6/2.4 | o-Xylene | 50 |
| 13 | Resin A(1) | 10 | Resin D(1) | 0.36 | CTM-1/CTM-2 | 5.6/2.4 | o-Xylene | 20 |
| 14 | Resin A(1) | 10 | Resin D(1) | 0.36 | CTM-1/CTM-2 | 5.6/2.4 | o-Xylene | 30 |
| 15 | Resin A(1) | 10 | Resin D(1) | 0.36 | CTM-1/CTM-2 | 5.6/2.4 | o-Xylene | 30 |
| 16 | Resin A(1) | 10 | Resin D(1) | 0.36 | CTM-1/CTM-2 | 5.6/2.4 | o-Xylene | 30 |
| 17 | Resin A(1) | 10 | Resin D(1) | 0.36 | CTM-1/CTM-2 | 5.6/2.4 | o-Xylene | 30 |
| 18 | Resin A(1) | 10 | Resin D(1) | 0.01 | CTM-1/CTM-2 | 5.6/2.4 | o-Xylene | 30 |
| 19 | Resin A(1) | 10 | Resin D(1) | 5 | CTM-1/CTM-2 | 5.6/2.4 | o-Xylene | 30 |
| 20 | Resin A(1) | 10 | Resin D(1) | 0.36 | CTM-1/CTM-2 | 5.6/2.4 | o-Xylene | 30 |
| 21 | Resin A(1) | 10 | Resin D(1) | 0.36 | CTM-1/CTM-2 | 5.6/2.4 | o-Xylene | 28 |
| 22 | Resin A(1) | 10 | Resin D(1) | 0.01 | CTM-1/CTM-2 | 5.6/2.4 | o-Xylene | 30 |
| 23 | Resin A(1) | 10 | Resin D(1) | 5 | CTM-1/CTM-2 | 5.6/2.4 | o-Xylene | 30 |
| 24 | Resin A(1) | 10 | Resin D(2) | 0.36 | CTM-1/CTM-2 | 5.6/2.4 | o-Xylene | 30 |
| 25 | Resin A(1) | 10 | Resin D(3) | 0.36 | CTM-1/CTM-2 | 5.6/2.4 | o-Xylene | 30 |
| 26 | Resin A(1) | 10 | Resin E(1) | 0.36 | CTM-1/CTM-2 | 5.6/2.4 | o-Xylene | 30 |
| 27 | Resin A(1) | 10 | Resin D(4) | 0.36 | CTM-1/CTM-2 | 5.6/2.4 | o-Xylene | 30 |

TABLE 4-continued

| | | | | | | | | |
|---|---|---|---|---|---|---|---|---|
| 28 | Resin A(1)/ Resin A(2) | 8/2 | Resin D(1) | 0.36 | CTM-1/CTM-2 | 5.6/2.4 | o-Xylene | 30 |
| 29 | Resin A(1)/ Resin A(2) | 8/2 | Resin D(1) | 0.36 | CTM-1/CTM-2 | 5.6/2.4 | o-Xylene | 30 |
| 30 | Resin A(1)/ Resin A(7) | 9/1 | Resin D(1) | 0.1 | CTM-1/CTM-2 | 5.6/2.4 | o-Xylene | 30 |

| | δ | | ϵ | |
|---|---|---|---|---|
| Example | Kind | Part(s) by mass | Kind | Part(s) by mass |
| 1 | Propylene carbonate | 2.5 | Dimethoxymethane | 20 |
| 2 | Propylene carbonate | 2.5 | Dimethoxymethane | 20 |
| 3 | Propylene carbonate | 2.5 | Dimethoxymethane | 20 |
| 4 | Propylene carbonate | 2.5 | Dimethoxymethane | 20 |
| 5 | Propylene carbonate | 2.5 | Dimethoxymethane | 20 |
| 6 | Propylene carbonate | 2.5 | Dimethoxymethane | 20 |
| 7 | Propylene carbonate | 2.5 | Dimethoxymethane | 20 |
| 8 | Propylene carbonate | 2.5 | Dimethoxymethane | 20 |
| 9 | Propylene carbonate | 2.5 | Dimethoxymethane | 20 |
| 10 | Propylene carbonate | 2.5 | Dimethoxymethane | 20 |
| 11 | Propylene carbonate | 2.5 | THF | 20 |
| 12 | Propylene carbonate | 2.5 | — | — |
| 13 | Propylene carbonate | 2.5 | Dimethoxymethane | 30 |
| 14 | γ-Butyrolactone | 2.5 | Dimethoxymethane | 20 |
| 15 | Propylene carbonate/ γ-Butyrolactone | 1.5/1 | Dimethoxymethane | 20 |
| 16 | δ-Valerolactone | 2.5 | Dimethoxymethane | 20 |
| 17 | ϵ-Caprolactone | 2.5 | Dimethoxymethane | 20 |
| 18 | Propylene carbonate | 2.5 | Dimethoxymethane | 20 |
| 19 | Propylene carbonate | 2.5 | Dimethoxymethane | 20 |
| 20 | Propylene carbonate | 0.5 | Dimethoxymethane | 20 |
| 21 | Propylene carbonate | 8 | Dimethoxymethane | 18 |
| 22 | Propylene carbonate | 0.5 | Dimethoxymethane | 20 |
| 23 | Propylene carbonate | 0.5 | Dimethoxymethane | 20 |
| 24 | Propylene carbonate | 2.5 | Dimethoxymethane | 20 |
| 25 | Propylene carbonate | 2.5 | Dimethoxymethane | 20 |
| 26 | Propylene carbonate | 2.5 | Dimethoxymethane | 20 |
| 27 | Propylene carbonate | 2.5 | Dimethoxymethane | 20 |
| 28 | Propylene carbonate | 2.5 | Dimethoxymethane | 20 |
| 29 | Propylene carbonate | 2.5 | Dimethoxymethane | 20 |
| 30 | Propylene carbonate | 2.5 | Dimethoxymethane | 20 |

TABLE 5

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 31 | Resin A(7) | 1C | Resin D(1) | 0.1 | CTM-1/CTM-2 | 5.6/2.4 | o-Xylene | 30 |
| 32 | Resin A(3) | 1C | Resin D(1) | 0.36 | CTM-1/CTM-2 | 5.6/2.4 | o-Xylene | 40 |
| 33 | Resin A(3) | 1C | Resin D(1) | 0.36 | CTM-1/CTM-2 | 4/4 | o-Xylene | 40 |
| 34 | Resin A(3) | 1C | Resin D(1) | 0.36 | CTM-1/CTM-3 | 7.2/0.8 | o-Xylene | 40 |
| 35 | Resin A(3)/ Resin A(8) | 9/1 | Resin D(1) | 0.1 | CTM-1/CTM-2 | 5.6/2.4 | o-Xylene | 40 |
| 36 | Resin A(3)/ Resin A(8) | 9/1 | Resin D(1) | 0.1 | CTM-1/CTM-3 | 7.2/0.8 | o-Xylene | 40 |
| 37 | Resin A(4) | 1C | Resin D(1) | 0.36 | CTM-1/CTM-2 | 5.6/2.4 | o-Xylene | 30 |
| 38 | Resin A(4) | 1C | Resin D(2) | 0.36 | CTM-1/CTM-2 | 5.6/2.4 | o-Xylene | 30 |
| 39 | Resin A(5) | 1C | Resin D(1) | 0.36 | CTM-1/CTM-2 | 5.6/2.4 | o-Xylene | 30 |
| 40 | Resin A(5) | 1C | Resin D(2) | 0.36 | CTM-1/CTM-2 | 5.6/2.4 | o-Xylene | 30 |
| 41 | Resin B(1) | 1C | Resin D(1) | 0.36 | CTM-1/CTM-2 | 5.6/2.4 | o-Xylene | 45 |
| 42 | Resin B(1) | 1C | Resin D(1) | 0.36 | CTM-1/CTM-2 | 8.1/0.9 | o-Xylene | 45 |
| 43 | Resin B(1) | 1C | Resin D(1) | 0.36 | CTM-1/CTM-3 | 8.1/0.9 | o-Xylene | 45 |
| 44 | Resin B(1) | 1C | Resin D(1) | 0.36 | CTM-1/CTM-2 | 5.6/2.4 | Toluene | 45 |
| 45 | Resin B(1) | 1C | Resin D(1) | 0.36 | CTM-1/CTM-2 | 5.6/2.4 | m-Xylene | 45 |
| 46 | Resin B(1) | 1C | Resin D(1) | 0.36 | CTM-1/CTM-2 | 5.6/2.4 | p-Xylene | 45 |
| 47 | Resin B(1) | 1C | Resin D(1) | 0.36 | CTM-1/CTM-2 | 5.6/2.4 | o-Xylene/ Toluene | 25/20 |
| 48 | Resin B(1) | 1C | Resin D(1) | 0.36 | CTM-1/CTM-2 | 5.6/2.4 | Toluene | 45 |
| 49 | Resin B(1) | 1C | Resin D(1) | 0.36 | CTM-1/CTM-2 | 5.6/2.4 | o-Xylene | 70 |
| 50 | Resin B(1) | 1C | Resin D(1) | 0.36 | CTM-1/CTM-2 | 5.6/2.4 | o-Xylene | 30 |
| 51 | Resin B(1) | 1C | Resin D(1) | 0.36 | CTM-1/CTM-2 | 5.6/2.4 | o-Xylene | 45 |
| 52 | Resin B(1) | 1C | Resin D(1) | 0.36 | CTM-1/CTM-2 | 5.6/2.4 | o-Xylene | 45 |
| 53 | Resin B(1) | 1C | Resin D(1) | 0.36 | CTM-1/CTM-2 | 5.6/2.4 | o-Xylene | 45 |

TABLE 5-continued

| | | | | | | | | |
|---|---|---|---|---|---|---|---|---|
| 54 | Resin B(1) | 1C | Resin D(1) | 0.36 | CTM-1/CTM-2 | 5.6/2.4 | o-Xylene | 45 |
| 55 | Resin B(1) | 1C | Resin D(1) | 0.01 | CTM-1/CTM-2 | 5.6/2.4 | o-Xylene | 45 |
| 56 | Resin B(1) | 1C | Resin D(1) | 5 | CTM-1/CTM-2 | 5.6/2.4 | o-Xylene | 45 |
| 57 | Resin B(1) | 1C | Resin D(1) | 0.36 | CTM-1/CTM-2 | 5.6/2.4 | o-Xylene | 45 |
| 58 | Resin B(1) | 1C | Resin D(1) | 0.36 | CTM-1/CTM-2 | 5.6/2.4 | o-Xylene | 40 |
| 59 | Resin B(1) | 1C | Resin D(1) | 0.01 | CTM-1/CTM-2 | 5.6/2.4 | o-Xylene | 45 |
| 60 | Resin B(1) | 1C | Resin D(1) | 5 | CTM-1/CTM-2 | 5.6/2.4 | o-Xylene | 45 |

| | δ | | ϵ | |
|---|---|---|---|---|
| Example | Kind | Part(s) by mass | Kind | Part(s) by mass |
| 31 | Propylene carbonate | 2.5 | Dimethoxymethane | 2C |
| 32 | Propylene carbonate | 2.5 | Dimethoxymethane | 3C |
| 33 | Propylene carbonate | 2.5 | Dimethoxymethane | 3C |
| 34 | Propylene carbonate | 2.5 | Dimethoxymethane | 3C |
| 35 | Propylene carbonate | 2.5 | Dimethoxymethane | 3C |
| 36 | Propylene carbonate | 2.5 | Dimethoxymethane | 3C |
| 37 | Propylene carbonate | 2.5 | Dimethoxymethane | 2C |
| 38 | Propylene carbonate | 2.5 | Dimethoxymethane | 2C |
| 39 | Propylene carbonate | 2.5 | Dimethoxymethane | 2C |
| 40 | Propylene carbonate | 2.5 | Dimethoxymethane | 2C |
| 41 | Propylene carbonate | 2.5 | Dimethoxymethane | 3C |
| 42 | Propylene carbonate | 2.5 | Dimethoxymethane | 3C |
| 43 | Propylene carbonate | 2.5 | Dimethoxymethane | 3C |
| 44 | Propylene carbonate | 2.5 | Dimethoxymethane | 3C |
| 45 | Propylene carbonate | 2.5 | Dimethoxymethane | 3C |
| 46 | Propylene carbonate | 2.5 | Dimethoxymethane | 3C |
| 47 | Propylene carbonate | 2.5 | Dimethoxymethane | 3C |
| 48 | Propylene carbonate | 2.5 | THF | 3C |
| 49 | Propylene carbonate | 2.5 | — | — |
| 50 | Propylene carbonate | 2.5 | Dimethoxymethane | 45 |
| 51 | γ-Butyrolactone | 2.5 | Dimethoxymethane | 3C |
| 52 | Propylene carbonate/ γ-Butyrolactone | 1.5/1 | Dimethoxymethane | 3C |
| 53 | δ-Valerolactone | 2.5 | Dimethoxymethane | 3C |
| 54 | ϵ-Caprolactone | 2.5 | Dimethoxymethane | 3C |
| 55 | Propylene carbonate | 2.5 | Dimethoxymethane | 3C |
| 56 | Propylene carbonate | 2.5 | Dimethoxymethane | 3C |
| 57 | Propylene carbonate | 0.5 | Dimethoxymethane | 3C |
| 58 | Propylene carbonate | 8 | Dimethoxymethane | 27 |
| 59 | Propylene carbonate | 0.5 | Dimethoxymethane | 3C |
| 60 | Propylene carbonate | 0.5 | Dimethoxymethane | 3C |

TABLE 6

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 61 | Resin B(1) | 10 | Resin D(1)/ Resin D(4) | 0.24/0.12 | CTM-1/CTM-2 | 5.6/2.4 | o-Xylene | 45 |
| 62 | Resin B(1) | 10 | Resin E(1) | 0.36 | CTM-1/CTM-2 | 5.6/2.4 | o-Xylene | 45 |
| 63 | Resin B(2) | 10 | Resin D(1) | 0.36 | CTM-1/CTM-2 | 5.6/2.4 | o-Xylene | 60 |
| 64 | Resin B(2) | 10 | Resin D(1) | 0.36 | CTM-1/CTM-2 | 5.6/2.4 | Toluene | 60 |
| 65 | Resin B(2) | 10 | Resin D(1) | 0.36 | CTM-1/CTM-2 | 5.6/2.4 | Toluene | 60 |
| 66 | Resin B(2) | 10 | Resin D(1) | 0.36 | CTM-1/CTM-2 | 5.6/2.4 | o-Xylene | 60 |
| 67 | Resin B(2) | 10 | Resin D(1) | 0.36 | CTM-1/CTM-2 | 5.6/2.4 | o-Xylene | 60 |
| 68 | Resin B(2) | 10 | Resin D(1) | 0.36 | CTM-1/CTM-2 | 5.6/2.4 | o-Xylene | 60 |
| 69 | Resin B(2) | 10 | Resin D(1) | 0.36 | CTM-1/CTM-2 | 5.6/2.4 | o-Xylene | 60 |
| 70 | Resin B(3) | 10 | Resin D(1) | 0.36 | CTM-1/CTM-2 | 5.6/2.4 | o-Xylene | 60 |
| 71 | Resin B(3) | 10 | Resin D(1) | 0.36 | CTM-1/CTM-2 | 5.6/2.4 | Toluene | 60 |
| 72 | Resin B(3) | 10 | Resin D(1) | 0.36 | CTM-1/CTM-2 | 5.6/2.4 | Toluene | 60 |
| 73 | Resin B(3) | 10 | Resin D(1) | 0.36 | CTM-1/CTM-2 | 5.6/2.4 | o-Xylene | 60 |
| 74 | Resin B(3) | 10 | Resin D(1) | 0.36 | CTM-1/CTM-2 | 5.6/2.4 | o-Xylene | 60 |
| 75 | Resin B(3) | 10 | Resin D(1) | 0.36 | CTM-1/CTM-2 | 5.6/2.4 | o-Xylene | 60 |
| 76 | Resin B(3) | 10 | Resin D(1) | 0.36 | CTM-1/CTM-2 | 5.6/2.4 | o-Xylene | 60 |
| 77 | Resin B(3) | 10 | Resin D(1) | 0.36 | CTM-1/CTM-2 | 5.6/2.4 | o-Xylene | 60 |
| 78 | Resin B(3) | 10 | Resin D(2) | 0.36 | CTM-1/CTM-2 | 5.6/2.4 | o-Xylene | 60 |
| 79 | Resin B(3) | 10 | Resin E(1) | 0.36 | CTM-1/CTM-2 | 5.6/2.4 | o-Xylene | 60 |
| 80 | Resin B(3)/ Resin B(6) | 7/3 | Resin D(1) | 0.36 | CTM-1/CTM-2 | 5.6/2.4 | o-Xylene | 60 |

TABLE 6-continued

| | | | | | | | | |
|---|---|---|---|---|---|---|---|---|
| 81 | Resin B(3)/ Resin B(6) | 7/3 | Resin D(1) | 0.36 | CTM-6/CTM-7 | 5.0/2.5 | o-Xylene | 60 |
| 82 | Resin A(1) | 10 | Resin D(1) | 0.36 | CTM-1/CTM-2 | 5.6/2.4 | o-Xylene | 12 |
| 83 | Resin B(1) | 10 | Resin D(1) | 0.36 | CTM-1/CTM-2 | 5.6/2.4 | o-Xylene | 18 |
| 84 | Resin A(3)/ Resin A(8) | 10 | Resin D(1) | 0.09 | CTM-1/CTM-2 | 7.2/0.8 | o-Xylene | 21 |
| 85 | Resin B(1)/ Resin A(3)/ Resin A(8) | 5/4/1 | Resin D(1) | 0.09 | CTM-1/CTM-2 | 8.1/0.9 | o-Xylene | 22.5 |

| | δ | | ϵ | |
|---|---|---|---|---|
| Example | Kind | Part(s) by mass | Kind | Part(s) by mass |
| 61 | Propylene carbonate | 2.5 | Dimethoxymethane | 30 |
| 62 | Propylene carbonate | 2.5 | Dimethoxymethane | 30 |
| 63 | Propylene carbonate | 2.5 | Dimethoxymethane | 40 |
| 64 | Propylene carbonate | 2.5 | Dimethoxymethane | 40 |
| 65 | Propylene carbonate | 2.5 | THF | 40 |
| 66 | γ-Butyrolactone | 2.5 | Dimethoxymethane | 40 |
| 67 | Propylene carbonate/ γ-Butyrolactone | 1.5/1 | Dimethoxymethane | 40 |
| 68 | δ-Valerolactone | 2.5 | Dimethoxymethane | 40 |
| 69 | ϵ-Caprolactone | 2.5 | Dimethoxymethane | 40 |
| 70 | Propylene carbonate | 2.5 | Dimethoxymethane | 40 |
| 71 | Propylene carbonate | 2.5 | Dimethoxymethane | 40 |
| 72 | Propylene carbonate | 2.5 | THF | 40 |
| 73 | γ-Butyrolactone | 2.5 | Dimethoxymethane | 40 |
| 74 | Propylene carbonate/ γ-Butyrolactone | 1.5/1 | Dimethoxymethane | 40 |
| 75 | δ-Valerolactone | 2.5 | Dimethoxymethane | 40 |
| 76 | ϵ-Caprolactone | 2.5 | Dimethoxymethane | 40 |
| 77 | Ethylene carbonate | 2.5 | Dimethoxymethane | 40 |
| 78 | Propylene carbonate | 2.5 | Dimethoxymethane | 40 |
| 79 | Propylene carbonate | 2.5 | Dimethoxymethane | 40 |
| 80 | Propylene carbonate | 2.5 | Dimethoxymethane | 40 |
| 81 | Propylene carbonate | 2.5 | Dimethoxymethane | 40 |
| 82 | Propylene carbonate | 18 | Dimethoxymethane | 20 |
| 83 | Propylene carbonate | 27 | Dimethoxymethane | 30 |
| 84 | Propylene carbonate | 14 | Dimethoxymethane | 35 |
| 85 | Propylene carbonate | 15 | Dimethoxymethane | 37.5 |

TABLE 7

| | α | | β | | CTM | | γ | |
|---|---|---|---|---|---|---|---|---|
| Comparative Example | Resin kind | Part(s) by mass | Resin kind | Part(s) by mass | Structure | Part(s) by mass | Kind | Part(s) by mass |
| 1 | Resin A(1) | 10 | Resin D(1) | 0.36 | CTM-1/CTM-2 | 5.6/2.4 | o-Xylene | 30 |
| 2 | Resin A(1) | 10 | Resin D(1) | 0.36 | CTM-1/CTM-2 | 5.6/2.4 | Toluene | 30 |
| 3 | Resin A(1) | 10 | Resin D(1) | 0.36 | CTM-1/CTM-2 | 5.6/2.4 | o-Xylene | 50 |
| 4 | Resin A(1) | 10 | Resin D(1) | 0.36 | CTM-1/CTM-2 | 5.6/2.4 | o-Xylene | 30 |
| 5 | Resin A(1) | 10 | Resin D(1) | 0.36 | CTM-1/CTM-2 | 5.6/2.4 | o-Xylene | 30 |
| 6 | Resin A(1) | 10 | Resin D(3) | 0.36 | CTM-1/CTM-2 | 5.6/2.4 | o-Xylene | 30 |
| 7 | Resin A(1) | 10 | Resin D(4) | 0.36 | CTM-1/CTM-2 | 5.6/2.4 | o-Xylene | 30 |
| 8 | Resin A(1)/ Resin A(2) | 8/2 | Resin D(1) | 0.36 | CTM-1/CTM-2 | 5.6/2.4 | o-Xylene | 30 |
| 9 | Resin A(1)/ Resin A(7) | 9/1 | Resin D(1) | 0.1 | CTM-1/CTM-2 | 5.6/2.4 | o-Xylene | 30 |
| 10 | Resin A(7) | 10 | Resin D(1) | 0.1 | CTM-1/CTM-2 | 5.6/2.4 | o-Xylene | 30 |
| 11 | Resin A(3) | 10 | Resin D(1) | 0.36 | CTM-1/CTM-2 | 5.6/2.4 | o-Xylene | 40 |
| 12 | Resin A(3)/ Resin A(8) | 9/1 | Resin D(1) | 0.1 | CTM-1/CTM-3 | 7.2/0.8 | o-Xylene | 40 |
| 13 | Resin A(4) | 10 | Resin D(1) | 0.36 | CTM-1/CTM-2 | 5.6/2.4 | o-Xylene | 30 |
| 14 | Resin A(5) | 10 | Resin D(1) | 0.36 | CTM-1/CTM-2 | 5.6/2.4 | o-Xylene | 30 |
| 15 | Resin B(1) | 10 | Resin D(1) | 0.36 | CTM-1/CTM-2 | 5.6/2.4 | o-Xylene | 45 |
| 16 | Resin B(1) | 10 | Resin D(1) | 0.36 | CTM-1/CTM-2 | 5.6/2.4 | Toluene | 45 |
| 17 | Resin B(1) | 10 | Resin D(1) | 0.36 | CTM-1/CTM-2 | 5.6/2.4 | o-Xylene | 70 |
| 18 | Resin B(1) | 10 | Resin D(1) | 0.36 | CTM-1/CTM-2 | 5.6/2.4 | o-Xylene | 45 |
| 19 | Resin B(1) | 10 | Resin D(1) | 0.36 | CTM-1/CTM-2 | 5.6/2.4 | o-Xylene | 45 |
| 20 | Resin B(2) | 10 | Resin D(1) | 0.36 | CTM-1/CTM-2 | 5.6/2.4 | o-Xylene | 60 |
| 21 | Resin B(3) | 10 | Resin D(1) | 0.36 | CTM-1/CTM-2 | 5.6/2.4 | o-Xylene | 60 |
| 22 | Resin B(3) | 10 | Resin D(1) | 0.36 | CTM-1/CTM-2 | 5.6/2.4 | Toluene | 60 |
| 23 | Resin B(3) | 10 | Resin D(1) | 0.36 | CTM-1/CTM-2 | 5.6/2.4 | o-Xylene | 60 |
| 24 | Resin B(3) | 10 | Resin D(1) | 0.36 | CTM-1/CTM-2 | 5.6/2.4 | o-Xylene | 60 |

TABLE 7-continued

| | | | | | | | | |
|---|---|---|---|---|---|---|---|---|
| 25 | Resin B(3)/ Resin A(6) | 7/3 | Resin D(1) | 0.36 | CTM-1/CTM-2 | 5.6/2.4 | o-Xylene | 60 |
| 26 | Resin A(1) | 10 | KF-96-100cs | 0.36 | CTM-1/CTM-2 | 5.6/2.4 | o-Xylene | 30 |
| 27 | Resin A(1) | 10 | KF-96-100cs | 0.36 | CTM-1/CTM-2 | 5.6/2.4 | Chlorobenzene | 30 |
| 28 | Resin A(1) | 10 | KF-96-100cs | 0.36 | CTM-1/CTM-2 | 5.6/2.4 | o-Xylene | 30 |

| | δ | | ϵ | |
|---|---|---|---|---|
| Comparative Example | Kind | Part(s) by mass | Kind | Part(s) by mass |
| 1 | — | — | Dimethoxymethane | 20 |
| 2 | — | — | THF | 20 |
| 3 | — | — | — | — |
| 4 | Diisobutyl ketone | 2.5 | Dimethoxymethane | 20 |
| 5 | n-Pentyl acetate | 2.5 | Dimethoxymethane | 20 |
| 6 | — | — | Dimethoxymethane | 20 |
| 7 | — | — | Dimethoxymethane | 20 |
| 8 | — | — | Dimethoxymethane | 20 |
| 9 | — | — | Dimethoxymethane | 20 |
| 10 | — | — | Dimethoxymethane | 20 |
| 11 | — | — | Dimethoxymethane | 30 |
| 12 | — | — | Dimethoxymethane | 30 |
| 13 | — | — | Dimethoxymethane | 20 |
| 14 | — | — | Dimethoxymethane | 20 |
| 15 | — | — | Dimethoxymethane | 30 |
| 16 | — | — | THF | 30 |
| 17 | — | — | — | — |
| 18 | Diisobutyl ketone | 2.5 | Dimethoxymethane | 30 |
| 19 | n-Pentyl acetate | 2.5 | Dimethoxymethane | 30 |
| 20 | — | — | Dimethoxymethane | 40 |
| 21 | — | — | Dimethoxymethane | 40 |
| 22 | — | — | THF | 40 |
| 23 | Diisobutyl ketone | 2.5 | Dimethoxymethane | 40 |
| 24 | n-Pentyl acetate | 2.5 | Dimethoxymethane | 40 |
| 25 | — | — | Dimethoxymethane | 40 |
| 26 | — | — | Dimethoxymethane | 20 |
| 27 | — | — | Dimethoxymethane | 20 |
| 28 | Propylene carbonate | 2.5 | Dimethoxymethane | 20 |

Examples 86 to 157

Electrophotographic photosensitive members were each produced in the same manner as in Example 1 except that in Example 1, the kinds and contents of the resin α, the resin β, the solvent γ, the compound δ, the charge-transporting substances, and the (ϵ) were changed as shown in Tables 8 to 10.

Examples 158 and 159

Electrophotographic photosensitive members were each produced in the same manner as in Examples 80 and 81 except that in Examples 80 and 81, the kinds and contents of the resin α and the resin β were changed as shown in Table 10.

Examples 160 to 163

Electrophotographic photosensitive members were each produced in the same manner as in Example 1 except that in Example 1, the kinds and contents of the resin α, the resin β, the solvent γ, the compound δ, the charge-transporting substances, and the (ϵ) were changed as shown in Table 10.

Comparative Examples 29 to 31

Electrophotographic photosensitive members were each produced in the same manner as in Example 86 except that in Example 86, the compound δ was not contained, or was changed to diisobutyl ketone or n-pentyl acetate as shown in Table 11. It should be noted that diisobutyl ketone and n-pentyl acetate are comparative compounds of the compound δ.

Comparative Examples 32 to 49

Electrophotographic photosensitive members were each produced in the same manner as in Example 1 except that in Example 86, the kinds and contents of the resin α, the solvent γ, the compound δ, the charge-transporting substances, and the (ϵ) were changed as shown in Table 11.

Comparative Example 50

An electrophotographic photosensitive member was produced in the same manner as in Example 158 except that in Example 158, the compound δ was not contained as shown in Table 11.

Comparative Examples 51 to 56

Electrophotographic photosensitive members were each produced in the same manner as in Example 1 except that in Example 1, the resin β was not contained, and the kinds and contents of the resin α and the compound δ were changed as shown in Table 11.

TABLE 8

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 86 | Resin A(1) | 10 | F-B | 0.18 | CTM-1/CTM-2 | 5.6/2.4 | o-Xylene | 30 |
| 87 | Resin A(1) | 10 | F-B | 0.1 | CTM-5 | 9.5 | o-Xylene | 30 |
| 88 | Resin A(1) | 10 | F-B | 0.18 | CTM-1/CTM-2 | 5.6/2.4 | Toluene | 30 |
| 89 | Resin A(1) | 10 | F-B | 0.18 | CTM-1/CTM-2 | 5.6/2.4 | m-Xylene | 30 |
| 90 | Resin A(1) | 10 | F-B | 0.18 | CTM-1/CTM-2 | 5.6/2.4 | p-Xylene | 30 |
| 91 | Resin A(1) | 10 | F-B | 0.18 | CTM-1/CTM-2 | 5.6/2.4 | o-Xylene/ Toluene | 15/15 |
| 92 | Resin A(1) | 10 | F-B | 0.18 | CTM-1/CTM-2 | 5.6/2.4 | Toluene | 30 |
| 93 | Resin A(1) | 10 | F-B | 0.18 | CTM-1/CTM-2 | 5.6/2.4 | o-Xylene | 50 |
| 94 | Resin A(1) | 10 | F-B | 0.18 | CTM-1/CTM-2 | 5.6/2.4 | o-Xylene | 20 |
| 95 | Resin A(1) | 10 | F-B | 0.18 | CTM-1/CTM-2 | 5.6/2.4 | o-Xylene | 30 |
| 96 | Resin A(1) | 10 | F-B | 0.18 | CTM-1/CTM-2 | 5.6/2.4 | o-Xylene | 30 |
| 97 | Resin A(1) | 10 | F-B | 0.18 | CTM-1/CTM-2 | 5.6/2.4 | o-Xylene | 30 |
| 98 | Resin A(1) | 10 | F-B | 0.18 | CTM-1/CTM-2 | 5.6/2.4 | o-Xylene | 30 |
| 99 | Resin A(1) | 10 | F-B | 0.01 | CTM-1/CTM-2 | 5.6/2.4 | o-Xylene | 30 |
| 100 | Resin A(1) | 10 | F-B | 5 | CTM-1/CTM-2 | 5.6/2.4 | o-Xylene | 30 |
| 101 | Resin A(1) | 10 | F-B | 0.18 | CTM-1/CTM-2 | 5.6/2.4 | o-Xylene | 30 |
| 102 | Resin A(1) | 10 | F-B | 0.18 | CTM-1/CTM-2 | 5.6/2.4 | o-Xylene | 28 |
| 103 | Resin A(1) | 10 | F-B | 0.01 | CTM-1/CTM-2 | 5.6/2.4 | o-Xylene | 30 |
| 104 | Resin A(1) | 10 | F-B | 5 | CTM-1/CTM-2 | 5.6/2.4 | o-Xylene | 30 |
| 105 | Resin A(1) | 10 | F-D | 0.18 | CTM-1/CTM-2 | 5.6/2.4 | o-Xylene | 30 |
| 106 | Resin A(1)/ Resin A(7) | 9.5/0.5 | F-B | 0.18 | CTM-1/CTM-2 | 5.6/2.4 | o-Xylene | 30 |
| 107 | Resin A(1)/ Resin A(7) | 9.5/0.5 | F-B | 0.18 | CTM-1/CTM-3 | 7.2/0.8 | o-Xylene | 30 |
| 108 | Resin A(1)/ Resin A(7) | 9.5/0.5 | F-B | 0.18 | CTM-1/CTM-4 | 5.6/2.4 | m-Xylene | 30 |
| 109 | Resin A(1)/ Resin A(7)/ Resin A(9) | 8.5/0.5/1 | F-B | 0.18 | CTM-1/CTM-2 | 5.6/2.4 | o-Xylene | 30 |
| 110 | Resin A(1)/ Resin A(7)/ Resin A(9) | 8.5/0.5/1 | F-B | 0.18 | CTM-1/CTM-3 | 7.2/0.8 | o-Xylene | 30 |
| 111 | Resin A(3)/Resin A(8)/Resin A(9) | 8.5/0.5/1 | F-B | 0.18 | CTM-1/CTM-2 | 5.6/2.4 | o-Xylene | 40 |
| 112 | Resin A(3)/Resin A(8)/Resin A(9) | 8.5/0.5/1 | F-B | 0.18 | CTM-1/CTM-3 | 7.2/0.8 | o-Xylene | 40 |
| 113 | Resin A(4) | 10 | F-B | 0.18 | CTM-1/CTM-2 | 5.6/2.4 | o-Xylene | 30 |

| | δ | | ϵ | |
|---|---|---|---|---|
| Example | Kind | Part(s) by mass | Kind | Part(s) by mass |
| 86 | Propylene carbonate | 2.5 | Dimethoxymethane | 20 |
| 87 | Propylene carbonate | 2.5 | Dimethoxymethane | 20 |
| 88 | Propylene carbonate | 2.5 | Dimethoxymethane | 20 |
| 89 | Propylene carbonate | 2.5 | Dimethoxymethane | 20 |
| 90 | Propylene carbonate | 2.5 | Dimethoxymethane | 20 |
| 91 | Propylene carbonate | 2.5 | Dimethoxymethane | 20 |
| 92 | Propylene carbonate | 2.5 | THF | 20 |
| 93 | Propylene carbonate | 2.5 | — | — |
| 94 | Propylene carbonate | 2.5 | Dimethoxymethane | 30 |
| 95 | γ-Butyrolactone | 2.5 | Dimethoxymethane | 20 |
| 96 | Propylene carbonate/γ-Butyrolactone | 1.5/1 | Dimethoxymethane | 20 |
| 97 | δ-Valerolactone | 2.5 | Dimethoxymethane | 20 |
| 98 | ϵ-Caprolactone | 2.5 | Dimethoxymethane | 20 |
| 99 | Propylene carbonate | 2.5 | Dimethoxymethane | 20 |
| 100 | Propylene carbonate | 2.5 | Dimethoxymethane | 20 |
| 101 | Propylene carbonate | 0.5 | Dimethoxymethane | 20 |
| 102 | Propylene carbonate | 8 | Dimethoxymethane | 18 |
| 103 | Propylene carbonate | 0.5 | Dimethoxymethane | 20 |
| 104 | Propylene carbonate | 0.5 | Dimethoxymethane | 20 |
| 105 | Propylene carbonate | 2.5 | Dimethoxymethane | 20 |
| 106 | Propylene carbonate | 2.5 | Dimethoxymethane | 20 |
| 107 | Propylene carbonate | 2.5 | Dimethoxymethane | 20 |
| 108 | Propylene carbonate | 2.5 | Dimethoxymethane | 20 |
| 109 | Propylene carbonate | 2.5 | Dimethoxymethane | 20 |
| 110 | Propylene carbonate | 2.5 | Dimethoxymethane | 20 |
| 111 | Propylene carbonate | 2.5 | Dimethoxymethane | 30 |

TABLE 8-continued

| | | | | |
|---|---|---|---|---|
| 112 | Propylene carbonate | 2.5 | Dimethoxymethane | 30 |
| 113 | Propylene carbonate | 2.5 | Dimethoxymethane | 20 |

TABLE 9

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 114 | Resin A(4) | 10 | F-D | 0.18 | CTM-1/CTM-2 | 5.6/2.4 | o-Xylene | 30 |
| 115 | Resin A(5) | 10 | F-B | 0.18 | CTM-1/CTM-2 | 5.6/2.4 | o-Xylene | 30 |
| 116 | Resin A(5) | 10 | F-D | 0.18 | CTM-1/CTM-2 | 5.6/2.4 | o-Xylene | 30 |
| 117 | Resin B(1) | 10 | F-B | 0.18 | CTM-1/CTM-2 | 5.6/2.4 | o-Xylene | 45 |
| 118 | Resin B(1) | 10 | F-B | 0.18 | CTM-1/CTM-3 | 8.1/0.9 | o-Xylene | 45 |
| 119 | Resin B(1) | 10 | F-B | 0.18 | CTM-1/CTM-2 | 5.6/2.4 | Toluene | 45 |
| 120 | Resin B(1) | 10 | F-B | 0.18 | CTM-1/CTM-2 | 5.6/2.4 | m-Xylene | 45 |
| 121 | Resin B(1) | 10 | F-B | 0.18 | CTM-1/CTM-2 | 5.6/2.4 | p-Xylene | 45 |
| 122 | Resin B(1) | 10 | F-B | 0.18 | CTM-1/CTM-2 | 5.6/2.4 | o-Xylene/Toluene | 25/20 |
| 123 | Resin B(1) | 10 | F-B | 0.18 | CTM-1/CTM-2 | 5.6/2.4 | Toluene | 45 |
| 124 | Resin B(1) | 10 | F-B | 0.18 | CTM-1/CTM-2 | 5.6/2.4 | o-Xylene | 70 |
| 125 | Resin B(1) | 10 | F-B | 0.18 | CTM-1/CTM-2 | 5.6/2.4 | o-Xylene | 30 |
| 126 | Resin B(1) | 10 | F-B | 0.18 | CTM-1/CTM-2 | 5.6/2.4 | o-Xylene | 45 |
| 127 | Resin B(1) | 10 | F-B | 0.18 | CTM-1/CTM-2 | 5.6/2.4 | o-Xylene | 45 |
| 128 | Resin B(1) | 10 | F-B | 0.18 | CTM-1/CTM-2 | 5.6/2.4 | o-Xylene | 45 |
| 129 | Resin B(1) | 10 | F-B | 0.18 | CTM-1/CTM-2 | 5.6/2.4 | o-Xylene | 45 |
| 130 | Resin B(1) | 10 | F-B | 0.01 | CTM-1/CTM-2 | 5.6/2.4 | o-Xylene | 45 |
| 131 | Resin B(1) | 10 | F-B | 5 | CTM-1/CTM-2 | 5.6/2.4 | o-Xylene | 45 |
| 132 | Resin B(1) | 10 | F-B | 0.18 | CTM-1/CTM-2 | 5.6/2.4 | o-Xylene | 45 |
| 133 | Resin B(1) | 10 | F-B | 0.18 | CTM-1/CTM-2 | 5.6/2.4 | o-Xylene | 40 |
| 134 | Resin B(1) | 10 | F-B | 0.01 | CTM-1/CTM-2 | 5.6/2.4 | o-Xylene | 45 |
| 135 | Resin B(1) | 10 | F-B | 5 | CTM-1/CTM-2 | 5.6/2.4 | o-Xylene | 45 |
| 136 | Resin B(1) | 10 | F-D | 0.18 | CTM-1/CTM-3 | 5.6/2.4 | o-Xylene | 45 |
| 137 | Resin B(1)/ Resin A(1)/ Resin A(8) | 5/4/1 | F-B | 0.18 | CTM-1/CTM-2 | 5.6/2.4 | o-Xylene | 45 |
| 138 | Resin B(1)/ Resin A(1)/ Resin A(8) | 5/4/1 | F-B | 0.18 | CTM-1/CTM-3 | 8.1/0.9 | o-Xylene | 45 |
| 139 | Resin B(1)/ Resin A(3)/ Resin A(8) | 5/4/1 | F-B | 0.18 | CTM-1/CTM-2 | 5.6/2.4 | o-Xylene | 45 |
| 140 | Resin B(1)/ Resin A(3)/ Resin A(8) | 5/4/1 | F-B | 0.18 | CTM-1/CTM-3 | 8.1/0.9 | o-Xylene | 45 |

| | δ | | ε | |
|---|---|---|---|---|
| Example | Kind | Part(s) by mass | Kind | Part(s) by mass |
| 114 | Propylene carbonate | 2.5 | Dimethoxymethane | 20 |
| 115 | Propylene carbonate | 2.5 | Dimethoxymethane | 20 |
| 116 | Propylene carbonate | 2.5 | Dimethoxymethane | 20 |
| 117 | Propylene carbonate | 2.5 | Dimethoxymethane | 30 |
| 118 | Propylene carbonate | 2.5 | Dimethoxymethane | 30 |
| 119 | Propylene carbonate | 2.5 | Dimethoxymethane | 30 |
| 120 | Propylene carbonate | 2.5 | Dimethoxymethane | 30 |
| 121 | Propylene carbonate | 2.5 | Dimethoxymethane | 30 |
| 122 | Propylene carbonate | 2.5 | Dimethoxymethane | 30 |
| 123 | Propylene carbonate | 2.5 | THF | 30 |
| 124 | Propylene carbonate | 2.5 | — | — |
| 125 | Propylene carbonate | 2.5 | Dimethoxymethane | 45 |
| 126 | γ-Butyrolactone | 2.5 | Dimethoxymethane | 30 |
| 127 | Propylene carbonate/ γ-Butyrolactone | 1.5/1 | Dimethoxymethane | 30 |
| 128 | δ-Valerolactone | 2.5 | Dimethoxymethane | 30 |
| 129 | ε-Caprolactone | 2.5 | Dimethoxymethane | 30 |
| 130 | Propylene carbonate | 2.5 | Dimethoxymethane | 30 |
| 131 | Propylene carbonate | 2.5 | Dimethoxymethane | 30 |
| 132 | Propylene carbonate | 0.5 | Dimethoxymethane | 30 |
| 133 | Propylene carbonate | 8 | Dimethoxymethane | 27 |
| 134 | Propylene carbonate | 0.5 | Dimethoxymethane | 30 |
| 135 | Propylene carbonate | 0.5 | Dimethoxymethane | 30 |
| 136 | Propylene carbonate | 2.5 | Dimethoxymethane | 30 |
| 137 | Propylene carbonate | 2.5 | Dimethoxymethane | 30 |
| 138 | Propylene carbonate | 2.5 | Dimethoxymethane | 30 |

TABLE 9-continued

| | | | | |
|---|---|---|---|---|
| 139 | Propylene carbonate | 2.5 | Dimethoxymethane | 30 |
| 140 | Propylene carbonate | 2.5 | Dimethoxymethane | 30 |

TABLE 10

| | α | | β | | CTM | | γ | |
|---|---|---|---|---|---|---|---|---|
| Example | Resin kind | Part(s) by mass | Resin kind | Part(s) by mass | Structure | Part(s) by mass | Kind | Part(s) by mass |
| 141 | Resin B(1)/ Resin A(9) | 9.5/0.5 | F-B | 0.18 | CTM-1/CTM-2 | 5.6/2.4 | o-Xylene | 45 |
| 142 | Resin B(1)/ Resin A(9) | 9.5/0.5 | F-B | 0.18 | CTM-1/CTM-3 | 7.2/0.8 | o-Xylene | 45 |
| 143 | Resin B(2) | 10 | F-B | 0.18 | CTM-1/CTM-2 | 5.6/2.4 | o-Xylene | 60 |
| 144 | Resin B(2) | 10 | F-B | 0.18 | CTM-1/CTM-3 | 7.2/0.8 | o-Xylene | 60 |
| 145 | Resin B(2) | 10 | F-B | 0.18 | CTM-1/CTM-2 | 5.6/2.4 | Toluene | 60 |
| 146 | Resin B(2) | 10 | F-B | 0.18 | CTM-1/CTM-2 | 5.6/2.4 | Toluene | 60 |
| 147 | Resin B(2) | 10 | F-B | 0.18 | CTM-1/CTM-2 | 5.6/2.4 | o-Xylene | 60 |
| 148 | Resin B(2) | 10 | F-B | 0.18 | CTM-1/CTM-2 | 5.6/2.4 | o-Xylene | 60 |
| 149 | Resin B(2) | 10 | F-B | 0.18 | CTM-1/CTM-2 | 5.6/2.4 | o-Xylene | 60 |
| 150 | Resin B(2) | 10 | F-B | 0.18 | CTM-1/CTM-2 | 5.6/2.4 | o-Xylene | 60 |
| 151 | Resin B(3) | 10 | F-B | 0.18 | CTM-1/CTM-2 | 5.6/2.4 | o-Xylene | 60 |
| 152 | Resin B(3) | 10 | F-B | 0.18 | CTM-1/CTM-2 | 5.6/2.4 | Toluene | 60 |
| 153 | Resin B(3) | 10 | F-B | 0.18 | CTM-1/CTM-2 | 5.6/2.4 | Toluene | 60 |
| 154 | Resin B(3) | 10 | F-B | 0.18 | CTM-1/CTM-2 | 5.6/2.4 | o-Xylene | 60 |
| 155 | Resin B(3) | 10 | F-B | 0.18 | CTM-1/CTM-2 | 5.6/2.4 | o-Xylene | 60 |
| 156 | Resin B(3) | 10 | F-B | 0.18 | CTM-1/CTM-2 | 5.6/2.4 | o-Xylene | 60 |
| 157 | Resin B(3) | 10 | F-B | 0.18 | CTM-1/CTM-2 | 5.6/2.4 | o-Xylene | 60 |
| 158 | Resin B(3)/ Resin A(6) | 7/3 | F-B | 0.18 | CTM-1/CTM-2 | 5.6/2.4 | o-Xylene | 60 |
| 159 | Resin B(3)/ Resin A(6) | 7/3 | F-B | 0.18 | CTM-6/CTM-7 | 5.0/2.5 | o-Xylene | 60 |
| 160 | Resin A(1) | 10 | F-B | 0.18 | CTM-1/CTM-2 | 5.6/2.4 | o-Xylene | 12 |
| 161 | Resin B(1) | 10 | F-B | 0.18 | CTM-1/CTM-2 | 5.6/2.4 | o-Xylene | 18 |
| 162 | Resin B(1)/ Resin A(3)/ Resin A(8) | 10 | F-B | 0.19 | CTM-1/CTM-2 | 8.1/0.9 | o-Xylene | 23 |
| 163 | Resin B(2) | 10 | F-B | 0.18 | CTM-1/CTM-2 | 7.2/0.8 | o-Xylene | 20 |

| | δ | | ϵ | |
|---|---|---|---|---|
| Example | Kind | Part(s) by mass | Kind | Part(s) by mass |
| 141 | Propylene carbonate | 2.5 | Dimethoxymethane | 30 |
| 142 | Propylene carbonate | 2.5 | Dimethoxymethane | 30 |
| 143 | Propylene carbonate | 2.5 | Dimethoxymethane | 40 |
| 144 | Propylene carbonate | 2.5 | Dimethoxymethane | 40 |
| 145 | Propylene carbonate | 2.5 | Dimethoxymethane | 40 |
| 146 | Propylene carbonate | 2.5 | THF | 40 |
| 147 | γ-Butyrolactone | 2.5 | Dimethoxymethane | 40 |
| 148 | Propylene carbonate/ γ-Butyrolactone | 1.5/1 | Dimethoxymethane | 40 |
| 149 | δ-Valerolactone | 2.5 | Dimethoxymethane | 40 |
| 150 | ϵ-Caprolactone | 2.5 | Dimethoxymethane | 40 |
| 151 | Propylene carbonate | 2.5 | Dimethoxymethane | 40 |
| 152 | Propylene carbonate | 2.5 | Dimethoxymethane | 40 |
| 153 | Propylene carbonate | 2.5 | THF | 40 |
| 154 | γ-Butyrolactone | 2.5 | Dimethoxymethane | 40 |
| 155 | Propylene carbonate/ γ-Butyrolactone | 1.5/1 | Dimethoxymethane | 40 |
| 156 | δ-Valerolactone | 2.5 | Dimethoxymethane | 40 |
| 157 | ϵ-Caprolactone | 2.5 | Dimethoxymethane | 40 |
| 158 | Propylene carbonate | 2.5 | Dimethoxymethane | 40 |
| 159 | Propylene carbonate | 2.5 | Dimethoxymethane | 40 |
| 160 | Propylene carbonate | 18 | Dimethoxymethane | 20 |
| 161 | Propylene carbonate | 27 | Dimethoxymethane | 30 |
| 162 | Propylene carbonate | 15 | Dimethoxymethane | 38 |
| 163 | Propylene carbonate | 30 | Dimethoxymethane | 50 |

TABLE 11

| Comparative Example | α Resin kind | α Part(s) by mass | β Resin kind | β Part(s) by mass | CTM Structure | CTM Part(s) by mass | γ Kind | γ Part(s) by mass |
|---|---|---|---|---|---|---|---|---|
| 29 | Resin A(1) | 10 | F-B | 0.18 | CTM-1/CTM-2 | 5.6/2.4 | o-Xylene | 3C |
| 30 | Resin A(1) | 10 | F-B | 0.18 | CTM-1/CTM-2 | 5.6/2.4 | o-Xylene | 3C |
| 31 | Resin A(1) | 10 | F-B | 0.18 | CTM-1/CTM-2 | 5.6/2.4 | o-Xylene | 3C |
| 32 | Resin A(1)/ Resin A(7) | 9.5/0.5 | F-B | 0.18 | CTM-1/CTM-2 | 5.6/2.4 | o-Xylene | 3C |
| 33 | Resin A(1)/ Resin A(7)/ Resin A(9) | 8.5/0.5/1 | F-B | 0.18 | CTM-1 /CTM-2 | 5.6/2.4 | o-Xylene | 3C |
| 34 | Resin A(3)/ Resin A(7)/ Resin A(9) | 8.5/0.5/1 | F-B | 0.18 | CTM-1 /CTM-3 | 7.2/0.8 | o-Xylene | 4C |
| 35 | Resin A(4) | 10 | F-B | 0.18 | CTM-1/CTM-2 | 5.6/2.4 | o-Xylene | 3C |
| 36 | Resin A(5) | 10 | F-B | 0.18 | CTM-1/CTM-2 | 5.6/2.4 | o-Xvlene | 3C |
| 37 | Resin B(1) | 10 | F-B | 0.18 | CTM-1/CTM-2 | 5.6/2,4 | o-Xylene | 45 |
| 38 | Resin B(1) | 10 | F-B | 0.18 | CTM-1/CTM-2 | 5.6/2.4 | Toluene | 45 |
| 39 | Resin B(1) | 10 | F-B | 0.18 | CTM-1/CTM-2 | 5.6/2.4 | o-Xylene | 7C |
| 40 | Resin B(1) | 10 | F-B | 0.18 | CTM-1/CTM-2 | 5.6/2.4 | o-Xylene | 45 |
| 41 | Resin B(1) | 10 | F-B | 0.18 | CTM-1/CTM-2 | 5.6/2.4 | o-Xylene | 45 |
| 42 | Resin B(1)/ Resin A(9) | 9.5/0.5 | F-B | 0.18 | CTM-1/CTM-3 | 7.2/0.8 | o-Xylene | 45 |
| 43 | Resin B(1)/ Resin A(1)/ Resin A(8) | 5/4/1 | F-B | 0.18 | CTM-1/CTM-3 | 8.1/0.9 | o-Xylene | 45 |
| 44 | Resin B(1)/ Resin A(3)/ Resin A(8) | 5/4/1 | F-B | 0.18 | CTM-1/CTM-3 | 8.1/0.9 | o-Xylene | 45 |
| 45 | Resin B(2) | 10 | F-B | 0.18 | CTM-1/CTM-2 | 5.6/2,4 | o-Xvlene | 6C |
| 46 | Resin 8(2) | 10 | F-B | 0.18 | CTM-1/CTM-2 | 5.6/2.4 | Toluene | 6C |
| 47 | Resin 8(2) | 10 | F-B | 0.18 | CTM-1/CTM-2 | 5.6/2.4 | o-Xvlene | 6C |
| 48 | Resin 8(2) | 10 | F-B | 0.18 | CTM-1/CTM-2 | 5.6/2.4 | o-Xvlene | 6C |
| 49 | Resin 8(3) | 10 | F-B | 0.18 | CTM-1/CTM-2 | 5.6/2.4 | o-Xvlene | 6C |
| 50 | Resin B(3)/ Resin A(6) | 7/3 | F-B | 0.18 | CTM-1/CTM-2 | 5.6/2.4 | o-Xvlene | 6C |
| 51 | Resin A(1) | 10 | — | — | CTM-1/CTM-2 | 5.6/2.4 | o-Xvlene | 3C |
| 52 | Resin A(1) | 10 | — | — | CTM-1/CTM-2 | 5.6/2.4 | o-Xvlene | 3C |
| 53 | Resin A(1)/ Resin A(7) | 9/1 | — | — | CTM-1/CTM-2 | 5.6/2.4 | o-Xylene | 3C |
| 54 | Resin A(1)/ Resin A(7) | 9/1 | — | — | CTM-1/CTM-2 | 5.6/2.4 | o-Xvlene | 3C |
| 55 | Resin A(7) | 10 | — | — | CTM-1/CTM-2 | 5.6/2.4 | o-Xvlene | 3C |
| 56 | Resin A(7) | 10 | — | — | CTM-1/CTM-2 | 5.6/2.4 | o-Xviene | 3C |

| Comparative Example | δ Kind | δ Part(s) by mass | ϵ Kind | ϵ Part(s) by mass |
|---|---|---|---|---|
| 29 | — | — | Dimethoxymethane | 20 |
| 30 | Diisobutyl ketone | 2.5 | Dimethoxymethane | 20 |
| 31 | n-Pentyl acetate | 2.5 | Dimethoxymethane | 20 |
| 32 | — | — | Dimethoxymethane | 20 |
| 33 | — | — | Dimethoxymethane | 20 |
| 34 | — | — | Dimethoxymethane | 30 |
| 35 | — | — | Dimethoxymethane | 20 |
| 36 | — | — | Dimethoxymethane | 20 |
| 37 | — | — | Dimethoxymethane | 30 |
| 38 | — | — | THF | 30 |
| 39 | — | — | — | — |
| 40 | Diisobutyl ketone | 2.5 | Dimethoxymethane | 30 |
| 41 | n-Pentyl acetate | 2.5 | Dimethoxymethane | 30 |
| 42 | — | — | Dimethoxymethane | 30 |
| 43 | — | — | Dimethoxymethane | 30 |
| 44 | — | — | Dimethoxymethane | 30 |
| 45 | — | — | Dimethoxymethane | 40 |
| 46 | — | — | THF | 40 |
| 47 | Diisobutyl ketone | 2.5 | Dimethoxymethane | 40 |
| 48 | n-Pentyl acetate | 2.5 | Dimethoxymethane | 40 |
| 49 | — | — | Dimethoxymethane | 40 |
| 50 | — | — | Dimethoxymethane | 40 |
| 51 | — | — | Dimethoxymethane | 20 |
| 52 | Propylene carbonate | 2.5 | Dimethoxymethane | 20 |

TABLE 11-continued

| | | | | |
|---|---|---|---|---|
| 53 | — | — | Dimethoxymethane | 20 |
| 54 | Propylene carbonate | 2.5 | Dimethoxymethane | 20 |
| 55 | — | — | Dimethoxymethane | 20 |
| 56 | Propylene carbonate | 2.5 | Dimethoxymethane | 20 |

Next, evaluations are described. The coefficients of kinetic friction of the electrophotographic photosensitive members produced in Examples and Comparative Examples were measured by the following method.

The coefficients of kinetic friction were measured under a normal-temperature and normal-humidity environment (23° C./50% RH) with HEIDON-14 manufactured by Shinto Scientific Co., Ltd. A blade (urethane rubber blade) was placed to be in contact with an electrophotographic photosensitive member in a state where a constant load (50 g/cm$^2$) was applied to the blade. Frictional force acting between the electrophotographic photosensitive member and the urethane rubber blade when the electrophotographic photosensitive member was moved in a parallel manner at a process speed of 50 mm/min was measured. The frictional force was measured as the strain amount of a strain gauge attached to the urethane rubber blade side and was converted into a tensile load (force applied to the photosensitive member). The coefficient of kinetic friction is determined by dividing the "force (frictional force) (gf) applied to the photosensitive member" when the urethane rubber blade is moving by the "load (gf) applied to the blade." A urethane blade (having a rubber hardness of 67°) manufactured by Hokushin Kogyo Co., Ltd. cut into a piece measuring 5 mm by 30 mm by 2 mm was used as the urethane rubber blade, and the coefficient of friction was measured in a width direction at a load of 50 g/cm$^2$ and an angle of 27°.

In addition, the abundance ratio of a silicon element in the surface of each of the electrophotographic photosensitive members was measured by employing electron spectroscopy for chemical analysis (ESCA). Electron spectroscopy for chemical analysis reveals an element distribution on the extreme surface of a substance. Quantum 2000 Scanning ESCA Microprobe manufactured by ULVAC-PHI, Inc. was used in the measurement.

Tables 12 and 13 show the resultant coefficients of kinetic friction and abundance ratios of the silicon element. It should be noted that in Examples 1 to 85 in each of which a polycarbonate resin or a polyester resin was used as the resin β, the coefficients of kinetic friction of Examples 1 to 85 were determined as relative values when the coefficient of kinetic friction of Comparative Example 6 in which the resin β was a polycarbonate resin or a polyester resin was defined as 1. Relative values for coefficients of kinetic friction were similarly determined for Comparative Examples 1 to 28. In Examples 86 to 163 in each of which a polyacrylate resin was used as the resin β, the coefficients of kinetic friction of Examples 86 to 163 were determined as relative values when the coefficient of kinetic friction of Comparative Example 48 in which the resin β was a polyacrylate resin was defined as 1. Relative values for coefficients of kinetic friction were similarly determined for Comparative Examples 29 to 56.

TABLE 12

| | Ratio between compositions (mass %) | | | | Relative value for coefficient of kinetic friction | Silicon |
|---|---|---|---|---|---|---|
| | (δ)/(α) | (δ)((α) + (β)) | (δ)/(γ) | (β)/(α) | (measured value) | element |
| Example | | | | | | |
| 1 | 25.0% | 24.1% | 8.3% | 3.6% | 0.33 (0.13) | 15.5% |
| 2 | 25.0% | 24.1% | 8.3% | 3.6% | 0.41 (0.16) | 13.8% |
| 3 | 25.0% | 24.1% | 8.3% | 3.6% | 0.33 (0.13) | 15.5% |
| 4 | 25.0% | 24.1% | 8.3% | 3.6% | 0.38 (0.15) | 14.3% |
| 5 | 25.0% | 24.1% | 8.3% | 3.6% | 0.33 (0.13) | 15.8% |
| 6 | 25.0% | 24.1% | 8.3% | 3.6% | 0.36 (0.14) | 15.0% |
| 7 | 25.0% | 24.1% | 8.3% | 3.6% | 0.38 (0.15) | 14.3% |
| 8 | 25.0% | 24.1% | 8.3% | 3.6% | 0.38 (0.15) | 14.4% |
| 9 | 25.0% | 24.1% | 8.3% | 3.6% | 0.36 (0.14) | 15.2% |
| 10 | 25.0% | 24.1% | 8.3% | 3.6% | 0.46 (0.18) | 13.0% |
| 11 | 25.0% | 24.1% | 8.3% | 3.6% | 0.44 (0.17) | 13.8% |
| 12 | 25.0% | 24.1% | 5.0% | 3.6% | 0.41 (0.16) | 14.0% |
| 13 | 25.0% | 24.1% | 12.5% | 3.6% | 0.46 (0.18) | 13.2% |
| 14 | 25.0% | 24.1% | 8.3% | 3.6% | 0.33 (0.13) | 15.5% |
| 15 | 25.0% | 24.1% | 8.3% | 3.6% | 0.33 (0.13) | 15.4% |
| 16 | 25.0% | 24.1% | 8.3% | 3.6% | 0.36 (0.14) | 15.0% |
| 17 | 25.0% | 24.1% | 8.3% | 3.6% | 0.41 (0.16) | 14.0% |
| 18 | 25.0% | 25.0% | 8.3% | 0.1% | 0.56 (0.22) | 12.8% |
| 19 | 25.0% | 16.7% | 8.3% | 50.0% | 0.33 (0.13) | 15.5% |
| 20 | 5.0% | 5.0% | 1.7% | 3.6% | 0.54 (0.21) | 12.5% |
| 21 | 80.0% | 77.2% | 28.6% | 3.6% | 0.41 (0.16) | 13.8% |
| 22 | 5.0% | 5.0% | 1.7% | 0.1% | 0.67 (0.26) | 11.8% |
| 23 | 5.0% | 3.3% | 1.7% | 50.0% | 0.62 (0.24) | 12.0% |
| 24 | 25.0% | 24.1% | 8.3% | 3.6% | 0.46 (0.18) | 13.1% |
| 25 | 25.0% | 24.1% | 8.3% | 3.6% | 0.36 (0.14) | 14.8% |
| 26 | 25.0% | 24.1% | 8.3% | 3.6% | 0.51 (0.20) | 12.7% |
| 27 | 25.0% | 24.1% | 8.3% | 3.6% | 0.72 (0.28) | 11.6% |
| 28 | 25.0% | 24.1% | 8.3% | 3.6% | 0.36 (0.14) | 14.8% |
| 29 | 25.0% | 24.1% | 8.3% | 3.6% | 0.36 (0.14) | 14.8% |
| 30 | 25.0% | 24.1% | 8.3% | 1.0% | 0.46 (0.18) | 13.6% |
| 31 | 25.0% | 24.8% | 8.3% | 1.0% | 0.44 (0.17) | 13.5% |
| 32 | 25.0% | 24.1% | 6.3% | 3.6% | 0.41 (0.16) | 14.0% |
| 33 | 25.0% | 24.1% | 6.3% | 3.6% | 0.46 (0.18) | 13.2% |
| 34 | 25.0% | 24.1% | 6.3% | 3.6% | 0.44 (0.17) | 13.5% |
| 35 | 25.0% | 24.1% | 6.3% | 1.0% | 0.54 (0.21) | 12.4% |
| 36 | 25.0% | 24.1% | 6.3% | 1.0% | 0.56 (0.22) | 12.4% |
| 37 | 25.0% | 24.1% | 8.3% | 3.6% | 0.46 (0.18) | 13.5% |
| 38 | 25.0% | 24.1% | 8.3% | 3.6% | 0.49 (0.19) | 13.3% |
| 39 | 25.0% | 24.1% | 8.3% | 3.6% | 0.46 (0.18) | 13.2% |
| 40 | 25.0% | 24.1% | 8.3% | 3.6% | 0.54 (0.21) | 12.8% |
| 41 | 25.0% | 24.1% | 5.6% | 3.6% | 0.28 (0.11) | 17.0% |
| 42 | 25.0% | 24.1% | 5.6% | 3.6% | 0.26 (0.10) | 17.6% |
| 43 | 25.0% | 24.1% | 5.6% | 3.6% | 0.26 (0.10) | 17.8% |
| 44 | 25.0% | 24.1% | 5.6% | 3.6% | 0.28 (0.11) | 17.0% |
| 45 | 25.0% | 24.1% | 5.6% | 3.6% | 0.28 (0.11) | 17.1% |
| 46 | 25.0% | 24.1% | 5.6% | 3.6% | 0.33 (0.13) | 15.5% |
| 47 | 25.0% | 24.1% | 5.6% | 3.6% | 0.28 (0.11) | 16.9% |
| 48 | 25.0% | 24.1% | 5.6% | 3.6% | 0.36 (0.14) | 14.9% |
| 49 | 25.0% | 24.1% | 3.6% | 3.6% | 0.31 (0.12) | 16.2% |
| 50 | 25.0% | 24.1% | 8.3% | 3.6% | 0.41 (0.16) | 14.0% |
| 51 | 25.0% | 24.1% | 5.6% | 3.6% | 0.26 (0.10) | 17.8% |
| 52 | 25.0% | 24.1% | 5.6% | 3.6% | 0.28 (0.11) | 17.0% |
| 53 | 25.0% | 24.1% | 5.6% | 3.6% | 0.33 (0.13) | 15.8% |
| 54 | 25.0% | 24.1% | 5.6% | 3.6% | 0.28 (0.11) | 17.2% |
| 55 | 25.0% | 25.0% | 5.6% | 0.1% | 0.46 (0.18) | 13.4% |
| 56 | 25.0% | 16.7% | 5.6% | 50.0% | 0.36 (0.14) | 15.0% |
| 57 | 5.0% | 4.8% | 1.1% | 3.6% | 0.41 (0.16) | 14.2% |
| 58 | 80.0% | 77.2% | 20.0% | 3.6% | 0.36 (0.14) | 15.1% |

TABLE 12-continued

| | Ratio between compositions (mass %) | | | | Relative value for coefficient of kinetic friction | Silicon element |
|---|---|---|---|---|---|---|
| | (δ)/(α) | (δ)((α) + (β)) | (δ)/(γ) | (β)/(α) | (measured value) | |
| 59 | 5.0% | 5.0% | 1.1% | 0.1% | 0.44 (0.17) | 13.7% |
| 60 | 5.0% | 3.3% | 1.1% | 50.0% | 0.41 (0.16) | 14.1% |
| 61 | 25.0% | 24.1% | 5.6% | 3.6% | 0.41 (0.16) | 13.8% |
| 62 | 25.0% | 24.1% | 5.6% | 3.6% | 0.41 (0.16) | 14.1% |
| 63 | 25.0% | 24.1% | 4.2% | 3.6% | 0.36 (0.14) | 15.1% |
| 64 | 25.0% | 24.1% | 4.2% | 3.6% | 0.33 (0.13) | 15.7% |
| 65 | 25.0% | 24.1% | 4.2% | 3.6% | 0.38 (0.15) | 14.5% |
| 66 | 25.0% | 24.1% | 4.2% | 3.6% | 0.36 (0.14) | 15.1% |
| 67 | 25.0% | 24.1% | 4.2% | 3.6% | 0.38 (0.15) | 14.5% |
| 68 | 25.0% | 24.1% | 4.2% | 3.6% | 0.36 (0.14) | 15.2% |
| 69 | 25.0% | 24.1% | 4.2% | 3.6% | 0.33 (0.13) | 15.8% |
| 70 | 25.0% | 24.1% | 4.2% | 3.6% | 0.41 (0.16) | 14.1% |
| 71 | 25.0% | 24.1% | 4.2% | 3.6% | 0.44 (0.17) | 13.7% |
| 72 | 25.0% | 24.1% | 4.2% | 3.6% | 0.49 (0.19) | 13.4% |
| 73 | 25.0% | 24.1% | 4.2% | 3.6% | 0.44 (0.17) | 13.7% |
| 74 | 25.0% | 24.1% | 4.2% | 3.6% | 0.41 (0.16) | 14.2% |
| 75 | 25.0% | 24.1% | 4.2% | 3.6% | 0.41 (0.16) | 14.2% |
| 76 | 25.0% | 24.1% | 4.2% | 3.6% | 0.44 (0.17) | 13.8% |
| 77 | 25.0% | 24.1% | 4.2% | 3.6% | 0.44 (0.17) | 13.8% |
| 78 | 25.0% | 24.1% | 4.2% | 3.6% | 0.33 (0.13) | 15.7% |
| 79 | 25.0% | 24.1% | 4.2% | 3.6% | 0.31 (0.12) | 16.4% |
| 80 | 25.0% | 24.1% | 4.2% | 3.6% | 0.41 (0.16) | 14.0% |
| 81 | 25.0% | 24.1% | 4.2% | 3.6% | 0.38 (0.15) | 14.5% |
| 82 | 180.0% | 173.7% | 150.0% | 3.6% | 0.33 (0.13) | 15.5% |
| 83 | 270.0% | 260.6% | 150.0% | 3.6% | 0.33 (0.13) | 15.7% |
| 84 | 140.0% | 138.8% | 66.7% | 0.9% | 0.41 (0.16) | 14.2% |
| 85 | 150.0% | 148.7% | 66.7% | 0.9% | 0.41 (0.16) | 14.0% |
| Comparative Example | | | | | | |
| 1 | — | — | — | 3.6% | 1.03 (0.40) | 11.0% |
| 2 | — | — | — | 3.6% | 1.08 (0.42) | 10.9% |
| 3 | — | — | — | 3.6% | 1.03 (0.40) | 11.0% |
| 4 | 25.0% | 24.1% | 8.3% | 3.6% | 1.05 (0.41) | 10.9% |
| 5 | 25.0% | 24.1% | 8.3% | 3.6% | 1.08 (0.42) | 10.9% |
| 6 | — | — | — | 3.6% | 1.00 (0.39) | 11.1% |
| 7 | — | — | — | 3.6% | 1.28 (0.50) | 10.4% |
| 8 | — | — | — | 3.6% | 1.00 (0.39) | 11.0% |
| 9 | — | — | — | 1.0% | 1.13 (0.44) | 10.7% |
| 10 | — | — | — | 1.0% | 1.08 (0.42) | 10.9% |
| 11 | — | — | — | 3.6% | 1.15 (0.45) | 10.7% |
| 12 | — | — | — | 0.1% | 1.10 (0.43) | 10.8% |
| 13 | — | — | — | 3.6% | 1.05 (0.41) | 10.9% |
| 14 | — | — | — | 3.6% | 1.08 (0.42) | 10.8% |
| 15 | — | — | — | 3.6% | 1.08 (0.42) | 10.8% |
| 16 | — | — | — | 3.6% | 1.10 (0.43) | 10.7% |
| 17 | — | — | — | 3.6% | 1.05 (0.41) | 10.8% |
| 18 | 25.0% | 24.1% | 5.6% | 3.6% | 1.08 (0.42) | 10.9% |
| 19 | 25.0% | 24.1% | 5.6% | 3.6% | 1.13 (0.44) | 10.7% |
| 20 | — | — | — | 3.6% | 1.15 (0.45) | 10.7% |
| 21 | — | — | — | 3.6% | 1.18 (0.46) | 10.6% |
| 22 | — | — | — | 3.6% | 1.13 (0.44) | 10.7% |
| 23 | 25.0% | 24.1% | 4.2% | 3.6% | 1.15 (0.45) | 10.6% |
| 24 | 25.0% | 24.1% | 4.2% | 3.6% | 1.18 (0.46) | 10.5% |
| 25 | — | — | — | 3.6% | 1.15 (0.45) | 10.7% |
| 26 | — | — | — | 3.6% | 1.15 (0.45) | 10.6% |
| 27 | — | — | — | 3.6% | 1.15 (0.45) | 10.7% |
| 28 | 25.0% | 24.1% | 8.3% | 3.6% | 1.13 (0.44) | 10.8% |

TABLE 13

| | Ratio between compositions (mass %) | | | | Relative value for coefficient of kinetic friction | Silicon element |
|---|---|---|---|---|---|---|
| | (δ)/(α) | (δ)((α) + (β)) | (δ)/(γ) | (β)/(α) | (measured value) | |
| Example | | | | | | |
| 86 | 25.0% | 24.6% | 8.3% | 1.8% | 0.70 (0.40) | 11.1% |
| 87 | 25.0% | 24.8% | 8.3% | 1.0% | 0.82 (0.47) | 10.8% |
| 88 | 25.0% | 24.6% | 8.3% | 1.8% | 0.74 (0.42) | 10.9% |
| 89 | 25.0% | 24.6% | 8.3% | 1.8% | 0.70 (0.40) | 11.1% |
| 90 | 25.0% | 24.6% | 8.3% | 1.8% | 0.70 (0.40) | 11.3% |
| 91 | 25.0% | 24.6% | 8.3% | 1.8% | 0.74 (0.42) | 10.6% |
| 92 | 25.0% | 24.6% | 8.3% | 1.8% | 0.77 (0.44) | 10.5% |
| 93 | 25.0% | 24.6% | 5.0% | 1.8% | 0.79 (0.45) | 10.4% |
| 94 | 25.0% | 24.6% | 12.5% | 1.8% | 0.82 (0.47) | 10.4% |
| 95 | 25.0% | 24.6% | 8.3% | 1.8% | 0.70 (0.40) | 10.8% |
| 96 | 25.0% | 24.6% | 8.3% | 1.8% | 0.68 (0.39) | 10.9% |
| 97 | 25.0% | 24.6% | 8.3% | 1.8% | 0.75 (0.43) | 10.8% |
| 98 | 25.0% | 24.6% | 8.3% | 1.8% | 0.77 (0.44) | 10.7% |
| 99 | 25.0% | 25.0% | 8.3% | 0.1% | 0.84 (0.48) | 10.5% |
| 100 | 25.0% | 16.7% | 8.3% | 50.0% | 0.81 (0.46) | 10.6% |
| 101 | 5.0% | 4.9% | 1.7% | 1.8% | 0.84 (0.48) | 10.3% |
| 102 | 80.0% | 78.6% | 28.6% | 1.8% | 0.70 (0.40) | 11.0% |
| 103 | 5.0% | 5.0% | 1.7% | 0.1% | 0.84 (0.48) | 10.2% |
| 104 | 5.0% | 3.3% | 1.7% | 50.0% | 0.88 (0.50) | 10.4% |
| 105 | 25.0% | 24.6% | 8.3% | 1.8% | 0.84 (0.48) | 10.5% |
| 106 | 25.0% | 24.6% | 8.3% | 1.8% | 0.68 (0.39) | 11.0% |
| 107 | 25.0% | 24.6% | 8.3% | 1.8% | 0.67 (0.38) | 11.1% |
| 108 | 25.0% | 24.6% | 8.3% | 1.8% | 0.67 (0.38) | 11.4% |
| 109 | 25.0% | 24.6% | 8.3% | 1.8% | 0.65 (0.37) | 11.2% |
| 110 | 25.0% | 24.6% | 8.3% | 1.8% | 0.65 (0.37) | 11.2% |
| 111 | 25.0% | 24.6% | 6.3% | 1.8% | 0.68 (0.39) | 11.0% |
| 112 | 25.0% | 24.6% | 6.3% | 1.8% | 0.68 (0.39) | 11.2% |
| 113 | 25.0% | 24.6% | 8.3% | 1.8% | 0.72 (0.41) | 10.9% |
| 114 | 25.0% | 24.6% | 8.3% | 1.8% | 0.70 (0.40) | 11.0% |
| 115 | 25.0% | 24.6% | 8.3% | 1.8% | 0.74 (0.42) | 10.9% |
| 116 | 25.0% | 24.6% | 8.3% | 1.8% | 0.75 (0.43) | 10.8% |
| 117 | 25.0% | 24.6% | 5.6% | 1.8% | 0.61 (0.35) | 11.3% |
| 118 | 25.0% | 24.6% | 5.6% | 1.8% | 0.65 (0.37) | 11.2% |
| 119 | 25.0% | 24.6% | 5.6% | 1.8% | 0.68 (0.39) | 11.1% |
| 120 | 25.0% | 24.6% | 5.6% | 1.8% | 0.68 (0.39) | 11.0% |
| 121 | 25.0% | 24.6% | 5.6% | 1.8% | 0.67 (0.38) | 11.1% |
| 122 | 25.0% | 24.6% | 5.6% | 1.8% | 0.68 (0.39) | 11.0% |
| 123 | 25.0% | 24.6% | 5.6% | 1.8% | 0.68 (0.39) | 10.8% |
| 124 | 25.0% | 24.6% | 3.6% | 1.8% | 0.68 (0.39) | 10.7% |
| 125 | 25.0% | 24.6% | 8.3% | 1.8% | 0.75 (0.43) | 10.4% |
| 126 | 25.0% | 24.6% | 5.6% | 1.8% | 0.68 (0.39) | 10.9% |
| 127 | 25.0% | 24.6% | 5.6% | 1.8% | 0.68 (0.39) | 11.0% |
| 128 | 25.0% | 24.6% | 5.6% | 1.8% | 0.72 (0.41) | 10.9% |
| 129 | 25.0% | 24.6% | 5.6% | 1.8% | 0.63 (0.36) | 11.2% |
| 130 | 25.0% | 25.0% | 5.6% | 0.1% | 0.81 (0.46) | 10.6% |
| 131 | 25.0% | 16.7% | 5.6% | 50.0% | 0.67 (0.38) | 11.3% |
| 132 | 5.0% | 4.9% | 1.1% | 1.8% | 0.70 (0.40) | 11.0% |
| 133 | 80.0% | 78.6% | 20.0% | 1.8% | 0.63 (0.36) | 11.3% |
| 134 | 5.0% | 5.0% | 1.1% | 0.1% | 0.74 (0.42) | 10.8% |
| 135 | 5.0% | 3.3% | 1.1% | 50.0% | 0.70 (0.40) | 11.0% |
| 136 | 25.0% | 24.6% | 5.6% | 1.8% | 0.68 (0.39) | 11.0% |
| 137 | 25.0% | 24.6% | 5.6% | 1.8% | 0.67 (0.38) | 11.1% |
| 138 | 25.0% | 24.6% | 5.6% | 1.8% | 0.63 (0.36) | 11.3% |
| 139 | 25.0% | 24.6% | 5.6% | 1.8% | 0.68 (0.39) | 11.0% |
| 140 | 25.0% | 24.6% | 5.6% | 1.8% | 0.63 (0.36) | 11.2% |
| 141 | 25.0% | 24.6% | 5.6% | 1.8% | 0.65 (0.37) | 11.3% |
| 142 | 25.0% | 24.6% | 5.6% | 1.8% | 0.67 (0.38) | 11.1% |
| 143 | 25.0% | 24.6% | 4.2% | 1.8% | 0.75 (0.43) | 10.8% |
| 144 | 25.0% | 24.6% | 4.2% | 1.8% | 0.72 (0.41) | 10.9% |
| 145 | 25.0% | 24.6% | 4.2% | 1.8% | 0.70 (0.40) | 11.0% |
| 146 | 25.0% | 24.6% | 4.2% | 1.8% | 0.81 (0.46) | 10.6% |
| 147 | 25.0% | 24.6% | 4.2% | 1.8% | 0.72 (0.41) | 10.9% |
| 148 | 25.0% | 24.6% | 4.2% | 1.8% | 0.70 (0.40) | 11.0% |
| 149 | 25.0% | 24.6% | 4.2% | 1.8% | 0.77 (0.44) | 10.4% |
| 150 | 25.0% | 24.6% | 4.2% | 1.8% | 0.75 (0.43) | 10.8% |
| 151 | 25.0% | 24.6% | 4.2% | 1.8% | 0.68 (0.39) | 11.0% |
| 152 | 25.0% | 24.6% | 4.2% | 1.8% | 0.68 (0.39) | 11.0% |
| 153 | 25.0% | 24.6% | 4.2% | 1.8% | 0.75 (0.43) | 10.8% |

TABLE 13-continued

| | Ratio between compositions (mass %) | | | | Relative value for coefficient of kinetic friction | Silicon |
|---|---|---|---|---|---|---|
| | (δ)/(α) | (δ)((α) + (β)) | (δ)/(γ) | (β)/(α) | (measured value) | element |
| 154 | 25.0% | 24.6% | 4.2% | 1.8% | 0.68 (0.39) | 11.0% |
| 155 | 25.0% | 24.6% | 4.2% | 1.8% | 0.70 (0.40) | 11.0% |
| 156 | 25.0% | 24.6% | 4.2% | 1.8% | 0.67 (0.38) | 11.1% |
| 157 | 25.0% | 24.6% | 4.2% | 1.8% | 0.72 (0.41) | 10.9% |
| 158 | 25.0% | 24.6% | 4.2% | 1.8% | 0.75 (0.43) | 10.8% |
| 159 | 25.0% | 24.6% | 4.2% | 1.8% | 0.77 (0.44) | 10.5% |
| 160 | 180.0% | 176.8% | 150.0% | 1.8% | 0.67 (0.38) | 11.1% |
| 161 | 270.0% | 265.2% | 150.0% | 1.8% | 0.61 (0.35) | 11.2% |
| 162 | 150.0% | 147.2% | 65.2% | 1.9% | 0.61 (0.35) | 11.3% |
| 163 | 300.0% | 294.7% | 150.0% | 1.8% | 0.67 (0.38) | 11.1% |
| Comparative Example | | | | | | |
| 29 | — | — | — | 1.8% | 1.18 (0.67) | 8.5% |
| 30 | 25.0% | 24.6% | 8.3% | 1.8% | 1.02 (0.58) | 9.8% |
| 31 | 25.0% | 24.6% | 8.3% | 1.8% | 1.09 (0.62) | 9.3% |
| 32 | — | — | — | 1.8% | 1.05 (0.60) | 9.4% |
| 33 | — | — | — | 1.8% | 1.07 (0.61) | 9.4% |
| 34 | — | — | — | 1.8% | 1.05 (0.60) | 9.5% |
| 35 | — | — | — | 1.8% | 1.16 (0.66) | 8.7% |
| 36 | — | — | — | 1.8% | 1.14 (0.65) | 8.9% |
| 37 | — | — | — | 1.8% | 1.09 (0.62) | 9.2% |
| 38 | — | — | — | 1.8% | 1.12 (0.64) | 9.0% |
| 39 | — | — | — | 1.8% | 1.12 (0.64) | 9.0% |
| 40 | 25.0% | 24.6% | 5.6% | 1.8% | 1.12 (0.64) | 9.0% |
| 41 | 25.0% | 24.6% | 5.6% | 1.8% | 1.11 (0.63) | 9.2% |
| 42 | — | — | — | 1.8% | 1.07 (0.61) | 9.4% |
| 43 | — | — | — | 1.8% | 1.05 (0.60) | 9.5% |
| 44 | — | — | — | 1.8% | 1.07 (0.61) | 9.4% |
| 45 | — | — | — | 1.8% | 1.07 (0.61) | 9.4% |
| 46 | — | — | — | 1.8% | 1.09 (0.62) | 9.3% |
| 47 | 25.0% | 24.6% | 4.2% | 1.8% | 1.02 (0.58) | 9.6% |
| 48 | 25.0% | 24.6% | 4.2% | 1.8% | 1.00 (0.57) | 9.6% |
| 49 | — | — | — | 1.8% | 1.19 (0.68) | 8.4% |
| 50 | — | — | — | 1.8% | 1.04 (0.59) | 9.7% |
| 51 | — | — | — | — | 2.42 (1.38) | 0.0% |
| 52 | 25.0% | 25.0% | 8.3% | — | 2.39 (1.36) | 0.0% |
| 53 | — | — | — | — | 2.28 (1.30) | 0.1% |
| 54 | 25.0% | 25.0% | 8.3% | — | 2.21 (1.26) | 0.1% |
| 55 | — | — | — | — | 1.93 (1.10) | 0.3% |
| 56 | 25.0% | 25.0% | 8.3% | — | 1.95 (1.11) | 0.3% |

In Table 12, the "coefficients of kinetic friction" of Examples and Comparative Examples show values relative to the coefficient of kinetic friction of Comparative Example 6 (0.39). It should be noted that a numerical value in parentheses is a value obtained by measuring a coefficient of kinetic friction. In Table 13, the "coefficients of kinetic friction" of Examples and Comparative Examples show values relative to the coefficient of kinetic friction of Comparative Example 48 (0.57). It should be noted that a numerical value in parentheses is a value obtained by measuring a coefficient of kinetic friction.

Comparison between Comparative Examples 1 to 3 and Examples shows that when the compound δ is not contained, the ratios of the silicon element in the surfaces are low and the coefficients of kinetic friction are high as compared with Examples. The same effect as the foregoing is exerted even when the kinds of the resin α, the resin β, the solvent γ, and the like are changed.

In addition, comparison between Comparative Examples 4 and 5, and Examples shows that even when the compound δ having a structure represented by the formula (1) is not contained and a solvent (diisobutyl ketone or n-pentyl acetate) having a boiling point higher than that of xylene or toluene is contained, the ratios of the silicon element in the surfaces cannot be increased and the coefficients of kinetic friction are not reduced. The same effect as the foregoing is exerted even when the kinds of the resin α, the resin β, the solvent γ, and the like are changed.

As can be seen from each of Comparative Examples 51 to 56, when the resin β is not contained, the coefficient of kinetic friction is extremely high irrespective of whether a resin having a siloxane moiety is contained or not as the resin α, and the reduction of the coefficient of friction by the addition of the compound δ is not observed.

Comparative Examples 26 to 28 each show that when the dimethyl silicone oil is used instead of the resin β, an effect due to the containing the compound δ is not observed and the coefficient of kinetic friction is not reduced. Further, there was no difference in coefficient of kinetic friction between the case where monochlorobenzene was used and the case where xylene was used, and a change in initial coefficient of friction by the use of xylene was substantially absent in the dimethyl silicone oil.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-007477, filed Jan. 18, 2013 which is hereby incorporated by reference herein in its entirety.

What is claimed is:

1. A method of producing an electrophotographic photosensitive member comprising a surface layer, wherein the method comprises the following steps of:

forming a coat of a surface-layer coating solution; and drying the coat to form the surface layer, wherein the surface-layer coating solution comprises:

(α) at least one resin selected from the group consisting of a polycarbonate resin not having a siloxane moiety at an end thereof, and a polyester resin not having a siloxane moiety at an end thereof;

(β) at least one resin selected from the group consisting of a polycarbonate resin having a siloxane moiety at an end thereof, a polyester resin having a siloxane moiety at an end thereof, and a polyacrylate resin having a siloxane moiety at an end thereof;

(γ) at least one solvent selected from the group consisting of toluene and xylene; and (δ) a compound having a boiling point in one atmosphere higher than that of the solvent of the (γ), the compound being represented by the following formula (1);

(1)

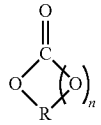

wherein, in the formula (1),

R represents an alkylene group having 1 to 5 carbon atoms, and n represents 0 or 1.

2. The method of producing an electrophotographic photosensitive member according to claim 1, wherein the compound of the (δ) comprises at least one selected from the group consisting of propylene carbonate, γ-butyrolactone, δ-valerolactone, and ϵ-caprolactone.

3. The method of producing an electrophotographic photosensitive member according to claim 1, wherein a content of the compound of the (δ) is 3 mass % or more and 300 mass % or less with respect to a total mass of the resin of the (α) and the resin of the (β), and is 0.5 mass % or more and 150 mass % or less with respect to a content of the solvent of the (γ).

4. The method of producing an electrophotographic photosensitive member according to claim 1, wherein a content of the compound of the (δ) is 5 mass % or more and 80 mass % or less with respect to a total mass of the resin of the (α) and the resin of the (β), and is 0.5 mass % or more and 40 mass % or less with respect to a content of the solvent of the (γ).

5. The method of producing an electrophotographic photosensitive member according to claim 1, wherein a content of the resin of the (β) is 0.1 mass % or more and 50 mass % or less with respect to a content of the resin of the (α).

6. The method of producing an electrophotographic photosensitive member according to claim 1, wherein the surface-layer coating solution further comprises (ϵ) at least one of dimethoxymethane and tetrahydrofuran.

7. The method of producing an electrophotographic photosensitive member according to claim 6, wherein with respect to a total mass of the solvent of the (γ), the compound of the (δ), and the (ϵ), a content of the solvent of the (γ) is 15 mass % or more and 99 mass % or less, a content of the compound of the (δ) is 0.5 mass % or more and 35 mass % or less, and a content of the (ϵ) is 0.1 mass % or more and 65 mass % or less.

8. The method of producing an electrophotographic photosensitive member according to claim 1, wherein the polycarbonate resin not having a siloxane moiety at an end thereof comprises a polycarbonate resin A having a structural unit represented by the following formula (A):

(A)

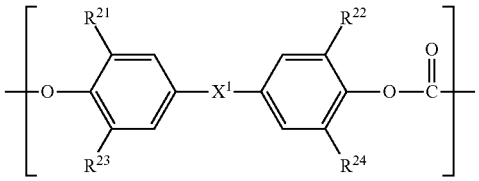

in the formula (A), $R^{21}$ to $R^{24}$ each independently represent a hydrogen atom or a methyl group, and $X^1$ represents a single bond, a cyclohexylidene group, or a divalent group having a structure represented by the following formula (C):

(C)

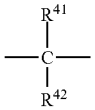

in the formula (C), $R^{41}$ and $R^{42}$ each independently represent a hydrogen atom, a methyl group, or a phenyl group.

9. The method of producing an electrophotographic photosensitive member according to claim 1, wherein the polyester resin not having a siloxane moiety at an end thereof comprises a polyester resin B having a structural unit represented by the following formula (B):

(B)

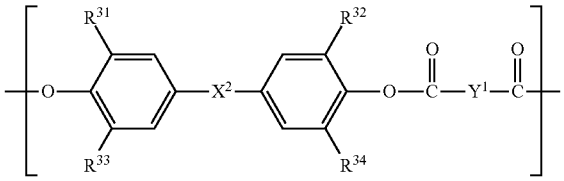

in the formula (B), $R^{31}$ to $R^{34}$ each independently represent a hydrogen atom or a methyl group, $X^2$ represents a single bond, a cyclohexylidene group, or a divalent group having a structure represented by the following formula (C), and $Y^1$ represents an m-phenylene group, a p-phenylene group, or a divalent group in which two p-phenylene groups are bonded through an oxygen atom:

(C)

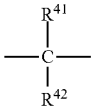

in the formula (C), $R^{41}$ and $R^{42}$ each independently represent a hydrogen atom, a methyl group, or a phenyl group.

10. The method of producing an electrophotographic photosensitive member according to claim 1, wherein the polycarbonate resin having a siloxane moiety at an end thereof comprises a polycarbonate resin D having a structural unit represented by the following formula (A') and an end structure represented by the following formula (D):

(A')

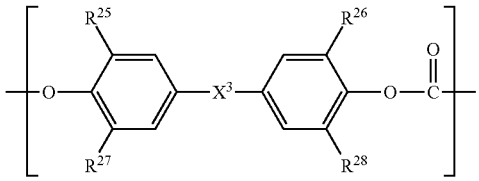

in the formula (A'), $R^{25}$ to $R^{28}$ each independently represent a hydrogen atom or a methyl group, and $X^3$ represents a single bond, a cyclohexylidene group, or a divalent group having a structure represented by the following formula (C'):

(C')

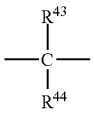

in the formula (C'), $R^{43}$ and $R^{44}$ each independently represent a hydrogen atom, a methyl group, or a phenyl group:

(D)

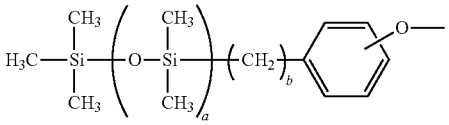

in the formula (D), "a" and "b" each independently represent a repetition number of a structure in respective parentheses, and an average value of "a" for the polycarbonate resin D is 20 or more and 100 or less, and an average value of "b" therefor is 1 or more and 10 or less.

11. The method of producing an electrophotographic photosensitive member according to claim 1, wherein the polyester resin having a siloxane moiety at an end thereof comprises a polyester resin E having a structural unit represented by the following formula (B') and an end structure represented by the following formula (D):

(B')

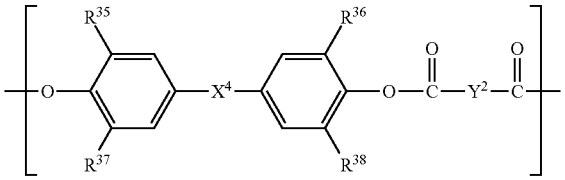

in the formula (B'), $R^{35}$ to $R^{38}$ each independently represent a hydrogen atom or a methyl group, $X^4$ represents a single bond, a cyclohexylidene group, or a divalent group having a structure represented by the following formula (C'), and $Y^2$ represents an m-phenylene group, a p-phenylene group, or a divalent group in which two p-phenylene groups are bonded through an oxygen atom:

(C')

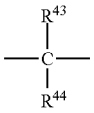

in the formula (C'), $R^{43}$ and $R^{44}$ each independently represent a hydrogen atom, a methyl group, or a phenyl group:

(D)

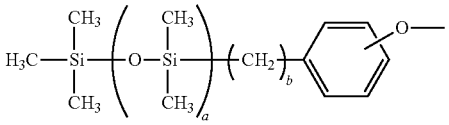

in the formula (D), "a" and "b" each independently represent a repetition number of "a" structure in respective parentheses, and an average value of a for the polyester resin E is 20 or more and 100 or less, and an average value of "b" therefor is 1 or more and 10 or less.

12. The method of producing an electrophotographic photosensitive member according to claim 1, wherein the polyacrylate resin having a siloxane moiety at an end thereof comprises one of a polyacrylate resin F having an end structure represented by the following formula (F-1) and a structural unit represented by the following formula (F-2), and a polyacrylate resin F having an end structure represented by the following formula (F-1) and a structural unit represented by the following formula (F-3):

(F-1)

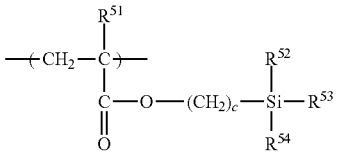

in the formula (F-1), $R^{51}$ represents a hydrogen atom or a methyl group, "c" represents a repetition number of a structure in a parenthesis, and an average value of "c" for the polyacrylate resin F is 0 or more and 5 or less, and $R^{52}$ to $R^{54}$ each independently represent a structure represented by the following formula (F-1-2), a methyl group, a methoxy group, or a phenyl group:

(F-1-2)

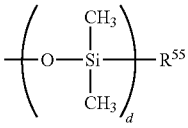

in the formula (F-1-2), "d" represents a repetition number of a structure in a parenthesis, and an average value of "d" for the polyacrylate resin F is 10 or more and 50 or less, and $R^{55}$ represents a hydroxy group or a methyl group:

(F-2)

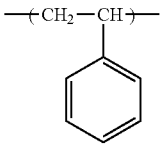

(F-3)

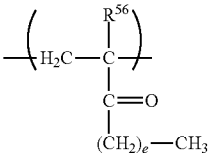

in the formula (F-3), $R^{56}$ represents a hydrogen atom, a methyl group, or a phenyl group, and "e" represents 0 or 1.

13. The method of producing an electrophotographic photosensitive member according to claim 1, wherein the solvent of the (γ) comprises xylene.

* * * * *